US007354072B2

(12) United States Patent
Yokote et al.

(10) Patent No.: US 7,354,072 B2
(45) Date of Patent: Apr. 8, 2008

(54) AUTHENTICATABLE PRINTED MATTER AND ITS PRODUCTION METHOD

(75) Inventors: Takao Yokote, Tokyo-To (JP); Kazuo Itoh, Tokyo-To (JP); Kazuhiko Shimada, Tokyo-To (JP)

(73) Assignee: National Printing Bureau, Incorporated Administrative Agency, Yokyo (JP)

( * ) Notice: Subject to any disclaimer, the term of this patent is extended or adjusted under 35 U.S.C. 154(b) by 682 days.

(21) Appl. No.: 10/486,013

(22) PCT Filed: Jul. 29, 2002

(86) PCT No.: PCT/JP02/07657

§ 371 (c)(1),
(2), (4) Date: Feb. 5, 2004

(87) PCT Pub. No.: WO03/013871

PCT Pub. Date: Feb. 20, 2003

(65) Prior Publication Data

US 2004/0195823 A1 Oct. 7, 2004

(30) Foreign Application Priority Data

Aug. 6, 2001 (JP) ..... 2001-237904

(51) Int. Cl.
*B42D 15/00* (2006.01)

(52) U.S. Cl. ..... 283/92; 283/113; 283/114; 283/901; 283/58; 428/916

(58) Field of Classification Search ..... 283/92, 283/93, 901–902, 113–114, 58, 59, 60.1; 428/913, 915, 916
See application file for complete search history.

(56) References Cited

U.S. PATENT DOCUMENTS

| | | | | |
|---|---|---|---|---|
| 4,033,059 | A | 7/1977 | Hutton et al. | |
| 4,066,280 | A * | 1/1978 | LaCapria | 283/91 |
| 4,715,623 | A * | 12/1987 | Roule et al. | 283/91 |
| 5,074,596 | A * | 12/1991 | Castagnoli | 283/91 |
| 5,199,744 | A * | 4/1993 | Shenton | 283/91 |
| 5,430,525 | A * | 7/1995 | Ohta et al. | 399/366 |
| 5,487,567 | A * | 1/1996 | Volpe | 283/72 |
| 5,596,425 | A * | 1/1997 | Usui et al. | 358/500 |
| 6,050,606 | A * | 4/2000 | Foresti | 283/93 |
| 6,139,066 | A * | 10/2000 | Mowry et al. | 283/93 |
| 6,167,147 | A * | 12/2000 | Mowry et al. | 382/135 |
| 6,296,281 | B1 * | 10/2001 | Stone | 283/93 |
| 6,659,508 | B1 * | 12/2003 | Nemeth et al. | 283/93 |

(Continued)

FOREIGN PATENT DOCUMENTS

| | | |
|---|---|---|
| GB | 1390302 | 4/1975 |

(Continued)

*Primary Examiner*—Daniel W. Howell
(74) *Attorney, Agent, or Firm*—The Webb Law Firm

(57) ABSTRACT

In authenticity determinable printed matter according to this invention, a background image portion and at least one message image portion are printed on a surface of a base member. The background image portion has a first line drawing which is arrayed in a first direction and printed by an ink with a specular gloss to have an ink layer thickness. The message image portion has a second line drawing which is arrayed in a second direction and printed by the ink with the specular gloss to have the ink layer thickness.

34 Claims, 20 Drawing Sheets

U.S. PATENT DOCUMENTS

2006/0151989 A1* 7/2006 Muke et al. ..... 283/67

FOREIGN PATENT DOCUMENTS

| | | | | |
|---|---|---|---|---|
| JP | 56-19273 | | | 5/1981 |
| JP | 63-66299 | | | 5/1988 |
| JP | 06-320699 | | | 11/1994 |
| JP | 07-164800 | | | 6/1995 |
| JP | 11-011069 | A | | 1/1999 |
| JP | 11-501590 | A | | 2/1999 |
| JP | 2001-106937 | A | | 4/2001 |
| JP | 2002285061 | A | * | 10/2002 |
| JP | 2002362069 | A | * | 12/2002 |
| JP | 2004027416 | A | * | 1/2004 |
| WO | WO 01/00426 | A1 | | 1/2001 |

* cited by examiner

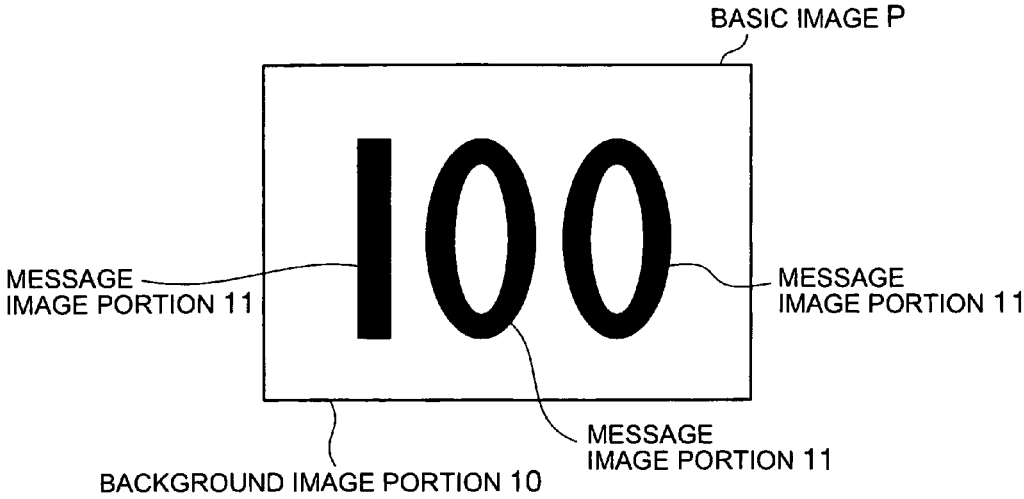
FIG. 11
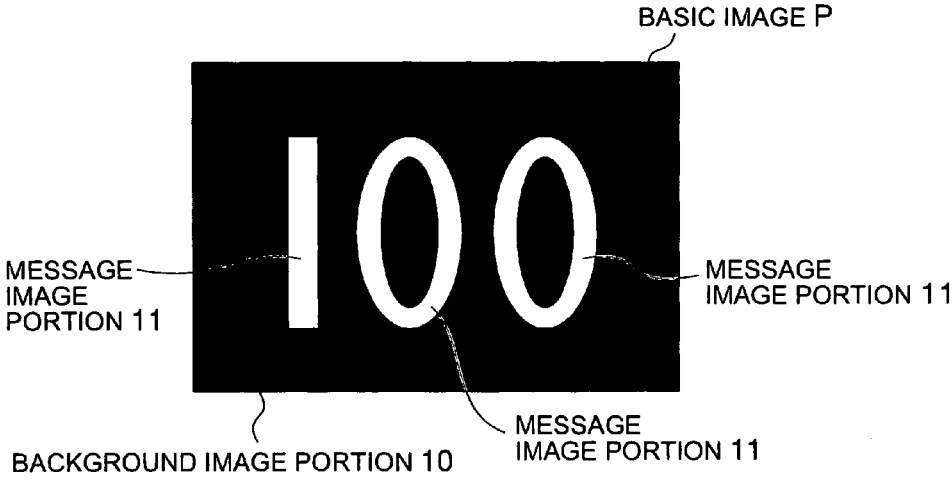
FIG. 12
| THICKNESS OF IMAGE LINE (μm) | 1 | 5 | 10 | 20 | 30 | 40 | 50 | 100 | 150 |
|---|---|---|---|---|---|---|---|---|---|
| EFFECT | × | △ | ○ | ○ | ○ | ○ | ○ | ○ | ○ |
FIG. 13

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), CYAN | | | | | | | | | |
| 93.84 | × | △ | ○ | ○ | ○ | ○ | ○ | ○ | ○ |
| 92.43 | × | △ | ○ | ○ | ○ | ○ | ○ | ○ | ○ |
| 90.64 | × | △ | ○ | ○ | ○ | ○ | ○ | ○ | ○ |
| 89.18 | × | △ | ○ | ○ | ○ | ○ | ○ | ○ | ○ |
| 87.49 | × | △ | ○ | ○ | ○ | ○ | ○ | ○ | ○ |
| 83.58 | × | △ | ○ | ○ | ○ | ○ | ○ | ○ | ○ |
| 79.25 | × | △ | ○ | ○ | ○ | ○ | ○ | ○ | ○ |
| 74.15 | × | △ | ○ | ○ | ○ | ○ | ○ | ○ | ○ |
| 69.62 | × | △ | ○ | ○ | ○ | ○ | ○ | ○ | ○ |
| 64.88 | × | △ | ○ | ○ | ○ | ○ | ○ | ○ | ○ |
| 59.16 | × | △ | ○ | ○ | ○ | ○ | ○ | ○ | ○ |
| 51.32 | × | △ | ○ | ○ | ○ | ○ | ○ | ○ | ○ |

FIG. 30

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), YELLOW | | | | | | | | | |
| 94.85 | × | △ | ○ | ○ | ○ | ○ | ○ | ○ | ○ |
| 94.59 | × | △ | ○ | ○ | ○ | ○ | ○ | ○ | ○ |
| 94.33 | × | △ | ○ | ○ | ○ | ○ | ○ | ○ | ○ |
| 94.08 | × | △ | ○ | ○ | ○ | ○ | ○ | ○ | ○ |
| 93.82 | × | △ | ○ | ○ | ○ | ○ | ○ | ○ | ○ |
| 93.36 | × | △ | ○ | ○ | ○ | ○ | ○ | ○ | ○ |
| 92.69 | × | △ | ○ | ○ | ○ | ○ | ○ | ○ | ○ |
| 92.18 | × | △ | ○ | ○ | ○ | ○ | ○ | ○ | ○ |
| 91.67 | × | △ | ○ | ○ | ○ | ○ | ○ | ○ | ○ |
| 91.18 | × | △ | ○ | ○ | ○ | ○ | ○ | ○ | ○ |
| 90.55 | × | △ | ○ | ○ | ○ | ○ | ○ | ○ | ○ |
| 89.65 | × | △ | ○ | ○ | ○ | ○ | ○ | ○ | ○ |

FIG. 31

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), MAGENTA | | | | | | | | | |
| 93.33 | × | △ | ○ | ○ | ○ | ○ | ○ | ○ | ○ |
| 91.13 | × | △ | ○ | ○ | ○ | ○ | ○ | ○ | ○ |
| 88.14 | × | △ | ○ | ○ | ○ | ○ | ○ | ○ | ○ |
| 85.12 | × | △ | ○ | ○ | ○ | ○ | ○ | ○ | ○ |
| 82.37 | × | △ | ○ | ○ | ○ | ○ | ○ | ○ | ○ |
| 76.04 | × | △ | ○ | ○ | ○ | ○ | ○ | ○ | ○ |
| 69.91 | × | △ | ○ | ○ | ○ | ○ | ○ | ○ | ○ |
| 63.37 | × | △ | ○ | ○ | ○ | ○ | ○ | ○ | ○ |
| 57.93 | × | △ | ○ | ○ | ○ | ○ | ○ | ○ | ○ |
| 52.71 | × | △ | ○ | ○ | ○ | ○ | ○ | ○ | ○ |
| 47.09 | × | △ | ○ | ○ | ○ | ○ | ○ | ○ | ○ |
| 40.76 | × | △ | ○ | ○ | ○ | ○ | ○ | ○ | ○ |

FIG. 32

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), GREEN | | | | | | | | | |
| 93.35 | × | △ | ○ | ○ | ○ | ○ | ○ | ○ | ○ |
| 91.49 | × | △ | ○ | ○ | ○ | ○ | ○ | ○ | ○ |
| 89.36 | × | △ | ○ | ○ | ○ | ○ | ○ | ○ | ○ |
| 87.51 | × | △ | ○ | ○ | ○ | ○ | ○ | ○ | ○ |
| 85.34 | × | △ | ○ | ○ | ○ | ○ | ○ | ○ | ○ |
| 80.28 | × | △ | ○ | ○ | ○ | ○ | ○ | ○ | ○ |
| 75.35 | × | △ | ○ | ○ | ○ | ○ | ○ | ○ | ○ |
| 69.47 | × | △ | ○ | ○ | ○ | ○ | ○ | ○ | ○ |
| 64.39 | × | △ | ○ | ○ | ○ | ○ | ○ | ○ | ○ |
| 58.91 | × | △ | ○ | ○ | ○ | ○ | ○ | ○ | ○ |
| 52.56 | × | △ | ○ | ○ | ○ | ○ | ○ | ○ | ○ |
| 43.89 | × | △ | ○ | ○ | ○ | ○ | ○ | ○ | ○ |

FIG. 33

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), BLACK | | | | | | | | | |
| 91.66 | × | △ | ○ | ○ | ○ | ○ | ○ | ○ | ○ |
| 88.45 | × | △ | ○ | ○ | ○ | ○ | ○ | ○ | ○ |
| 83.87 | × | △ | ○ | ○ | ○ | ○ | ○ | ○ | ○ |
| 79.81 | × | △ | ○ | ○ | ○ | ○ | ○ | ○ | ○ |
| 75.6 | × | △ | ○ | ○ | ○ | ○ | ○ | ○ | ○ |
| 67.02 | × | △ | ○ | ○ | ○ | ○ | ○ | ○ | ○ |
| 59.25 | × | △ | ○ | ○ | ○ | ○ | ○ | ○ | ○ |
| 50.71 | × | △ | ○ | ○ | ○ | ○ | ○ | ○ | ○ |
| 42.51 | × | △ | ○ | ○ | ○ | ○ | ○ | ○ | ○ |
| 34.32 | × | △ | ○ | ○ | ○ | ○ | ○ | ○ | ○ |
| 25.09 | × | △ | ○ | ○ | ○ | ○ | ○ | ○ | ○ |
| 13.12 | × | △ | ○ | ○ | ○ | ○ | ○ | ○ | ○ |

FIG. 34

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), CYAN | | | | | | | | | |
| 93.84 | ○ | ○ | ○ | ○ | ○ | ○ | ○ | ○ | ○ |
| 92.43 | ○ | ○ | ○ | ○ | ○ | ○ | ○ | ○ | ○ |
| 90.64 | ○ | ○ | ○ | ○ | ○ | ○ | ○ | ○ | ○ |
| 89.18 | △ | △ | △ | △ | △ | △ | △ | △ | △ |
| 87.49 | × | × | × | × | × | × | × | × | × |
| 83.58 | × | × | × | × | × | × | × | × | × |
| 79.25 | × | × | × | × | × | × | × | × | × |
| 74.15 | × | × | × | × | × | × | × | × | × |
| 69.62 | × | × | × | × | × | × | × | × | × |
| 64.88 | × | × | × | × | × | × | × | × | × |
| 59.16 | × | × | × | × | × | × | × | × | × |
| 51.32 | × | × | × | × | × | × | × | × | × |

FIG. 35

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), YELLOW | | | | | | | | | |
| 94.85 | ○ | ○ | ○ | ○ | ○ | ○ | ○ | ○ | ○ |
| 94.59 | ○ | ○ | ○ | ○ | ○ | ○ | ○ | ○ | ○ |
| 94.33 | ○ | ○ | ○ | ○ | ○ | ○ | ○ | ○ | ○ |
| 94.08 | ○ | ○ | ○ | ○ | ○ | ○ | ○ | ○ | ○ |
| 93.82 | ○ | ○ | ○ | ○ | ○ | ○ | ○ | ○ | ○ |
| 93.36 | ○ | ○ | ○ | ○ | ○ | ○ | ○ | ○ | ○ |
| 92.69 | ○ | ○ | ○ | ○ | ○ | ○ | ○ | ○ | ○ |
| 92.18 | ○ | ○ | ○ | ○ | ○ | ○ | ○ | ○ | ○ |
| 91.67 | ○ | ○ | ○ | ○ | ○ | ○ | ○ | ○ | ○ |
| 91.18 | ○ | ○ | ○ | ○ | ○ | ○ | ○ | ○ | ○ |
| 90.55 | ○ | ○ | ○ | ○ | ○ | ○ | ○ | ○ | ○ |
| 89.65 | △ | △ | △ | △ | △ | △ | △ | △ | △ |

FIG. 36

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), MAGENTA | | | | | | | | | |
| 93.33 | ○ | ○ | ○ | ○ | ○ | ○ | ○ | ○ | ○ |
| 91.13 | ○ | ○ | ○ | ○ | ○ | ○ | ○ | ○ | ○ |
| 88.14 | △ | △ | △ | △ | △ | △ | △ | △ | △ |
| 85.12 | × | × | × | × | × | × | × | × | × |
| 82.37 | × | × | × | × | × | × | × | × | × |
| 76.04 | × | × | × | × | × | × | × | × | × |
| 69.91 | × | × | × | × | × | × | × | × | × |
| 63.37 | × | × | × | × | × | × | × | × | × |
| 57.93 | × | × | × | × | × | × | × | × | × |
| 52.71 | × | × | × | × | × | × | × | × | × |
| 47.09 | × | × | × | × | × | × | × | × | × |
| 40.76 | × | × | × | × | × | × | × | × | × |

FIG. 37

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), GREEN | | | | | | | | | |
| 93.35 | ○ | ○ | ○ | ○ | ○ | ○ | ○ | ○ | ○ |
| 91.49 | ○ | ○ | ○ | ○ | ○ | ○ | ○ | ○ | ○ |
| 89.36 | △ | △ | △ | △ | △ | △ | △ | △ | △ |
| 87.51 | × | × | × | × | × | × | × | × | × |
| 85.34 | × | × | × | × | × | × | × | × | × |
| 80.28 | × | × | × | × | × | × | × | × | × |
| 75.35 | × | × | × | × | × | × | × | × | × |
| 69.47 | × | × | × | × | × | × | × | × | × |
| 64.39 | × | × | × | × | × | × | × | × | × |
| 58.91 | × | × | × | × | × | × | × | × | × |
| 52.56 | × | × | × | × | × | × | × | × | × |
| 43.89 | × | × | × | × | × | × | × | × | × |

FIG. 38

| THICKNESS OF IMAGE LINE OF SECOND IMAGE (μm) | 1 | 5 | 10 | 20 | 30 | 40 | 50 | 100 | 150 |
|---|---|---|---|---|---|---|---|---|---|
| LIGHTNESS OF FIRST IMAGE (L*), BLACK | | | | | | | | | |
| 91.66 | ○ | ○ | ○ | ○ | ○ | ○ | ○ | ○ | ○ |
| 88.45 | △ | △ | △ | △ | △ | △ | △ | △ | △ |
| 83.87 | × | × | × | × | × | × | × | × | × |
| 79.81 | × | × | × | × | × | × | × | × | × |
| 75.6 | × | × | × | × | × | × | × | × | × |
| 67.02 | × | × | × | × | × | × | × | × | × |
| 59.25 | × | × | × | × | × | × | × | × | × |
| 50.71 | × | × | × | × | × | × | × | × | × |
| 42.51 | × | × | × | × | × | × | × | × | × |
| 34.32 | × | × | × | × | × | × | × | × | × |
| 25.09 | × | × | × | × | × | × | × | × | × |
| 13.12 | × | × | × | × | × | × | × | × | × |

FIG. 39

| EFFECT | STRAIGHT | OBLIQUE |
|---|---|---|
| LINE DRAWING PITCH | | |
| 30 | ○ | ○ |
| 60 | ○ | ○ |
| 90 | ○ | ○ |
| 120 | ○ | ○ |
| 200 | ○ | ○ |
| 500 | ○ | ○ |
| 1000 | △ | ○ |
| 1500 | × | ○ |

FIG. 40

AUTHENTICATABLE PRINTED MATTER AND ITS PRODUCTION METHOD

BACKGROUND OF THE INVENTION

The present invention relates to authenticity determinable printed matter and a method of manufacturing the same.

In a technique used for valuable printed matter such as banknotes, stock certificates, securities, passes, and cards which require anti-forgery and anti-alteration measures, authenticity is determined by checking whether a latent image is visually recognized when printed matter is observed at an angle. Such printed matter uses, e.g., an image line structure of intaglio printed matter, a base member with a three-dimensional pattern and printed image lines, or a change in optical characteristic of ink.

A technique for making a latent image visible by using the image line structure of intaglio printed matter is disclosed in, e.g., Japanese Patent Publication No. 56-19273, in which an image line portion serving as a latent image is formed by using image lines having a large ink layer thickness on intaglio-printed straight lines, and a non-image line portion is formed by using image lines having a small ink layer thickness than the image line portion. When this printed matter is observed while changing the observation angle, the latent image becomes visible because the space between the straight lines is hidden by the image lines having an ink layer thickness in the image line portion at a position ahead of the non-image line portion.

In this technique, however, if observation is done from the direction of straight lines, the latent image is not visible. It is visible only from a direction perpendicular to the straight lines. In addition, since the latent image becomes visible depending on only the height difference between the image line portion and the non-image line portion, it is not easy to visually recognize the latent image.

Japanese Patent Publication No. 56-19273 discloses printed matter in which a latent image becomes visible because the image lines have a uniform width but different directions. In this printed matter, however, the latent image formation position can easily be visually specified. In addition, to make the latent image visible, the observation angle must be large (the printed matter must be tilted largely from the horizontal state). If the latent image should appear at a small observation angle, the ink layer thickness must be large. This is however difficult in producing printed matter.

In an example of printed matter that makes a latent image visible by using a change in optical characteristic of ink, a pattern is formed on the lower surface by gravure printing or silk-screen printing by using ink containing a scaly pigment, as is disclosed in, e.g., Japanese Patent Laid-Open No. 11-11069. According to this technique, the pattern thickness changes depending on the observation angle because of unevenness in scaly pigment distribution. The pattern color also changes. In addition, characters or the like can be added to the pattern. The characters become visible or invisible when the observation angle changes. The lightness (L*) on the base member surface, which is defined by JIS Z8729, falls within the range of 0 to 80 and, preferably, 0 to 45. When the scaly pigment has 1 to 50 wt % and, preferably, 5 to 30 wt % with respect to the ink, the pattern disappearance effect can be made conspicuous.

In this method, however, since the pattern is made visible by changing the pigment distribution density, the density and film thickness on the printed matter become ununiform. For this reason, the pattern is readily visually recognized in a normal state, so the latent image formation position can easily be specified by a third party.

Furthermore, since the pattern that should appear is a simple solid image that is not formed by image lines, only a monotonical pattern is obtained by making the change in color visible or invisible.

PCT(WO) 11-501590 discloses a data carrier having an optical change structure. A three-dimensional pattern is formed on this data carrier by embossing so that the data carrier obtains an optical conversion element with an anti-forgery effect.

In this method, however, embossing is performed after printing on the surface, or printing is performed after embossing. Two steps, printing and embossing, are necessary. In addition, a shift may occur between an embossing position and a printing position.

Furthermore, embossed traces remain even on the lower surface of the embossed printed matter. This adversely affects the image pattern on the lower surface. Moreover, when some pressure is applied to the printed matter, the embossed portion is lost, and hence, the visual embossing effect is lost.

An example of conventional printed matter makes a latent image visible by using a base member having a three-dimensional pattern and printed image lines. For example, Japanese Patent No. 2615401 by the present applicant discloses printed matter which uses a material on which various kinds of straight lines or relief representing an image pattern, or both of them are formed by embossing. Image lines made of various kinds of straight lines or image lines made of halftone dots having a predetermined interval, or image lines of both types are printed on the material to be parallel or have an angle to a portion except the above-described three-dimensional image pattern by using color inks except the ink of the color of the material or colorless ink.

According to this printed matter, when it is observed from the front, the image lines made of various kinds of straight lines or image lines made of halftone dots, which are formed by straight lines at a predetermined interval, or the image lines of both types are confirmed. When the printed matter is observed from an oblique direction, the three-dimensional image pattern is easily be confirmed depending on the positional relationship between the three-dimensional pattern and the printed image lines having a predetermined interval. When the printed matter is observed from a reverse oblique direction, the image pattern with its bright and dark portions inverted is confirmed.

In this printed matter, however, embossing is performed after printing on the surface, or printing is performed after embossing. This technique also requires two steps, i.e., printing and embossing.

In printed matter disclosed in Japanese Utility Model Laid-Open No. 05-76765, a solid polarizing ink layer containing pearl pigment is printed on the entire surface of a base member sheet. An abstract image pattern or character pattern made of an aggregate of straight or curved lines is printed on the polarizing ink layer by using color inks. Light that becomes incident from the upper surface side is periodically reflected in a predetermined direction by the pearl pigment in the polarizing ink layer to generate a gloss. Simultaneously, the abstract image pattern or character pattern printed by the color inks becomes visible.

In such printed matter, the line drawing is printed by using a normal ink. Hence, the printed matter may be copied, and the latent image effect is insufficient.

Printed matter disclosed in Japanese Patent Laid-Open No. 11-11069 makes a pattern visible by changing the pigment distribution density and ink layer thickness between the background portion and the character portion contained in the pattern. In this technique, since the density and film thickness on the printed matter become ununiform, the latent image formation position can easily be confirmed by a third party. If image lines with thicknesses are printed by using an ink mixed with a normal scaly pigment, the pigment may settle to lose the effect of the scaly pigment. In some cases, the latent image disappears, or its appearance is not conspicuous. In addition, the lightness of the base member must be limited.

In the above prior arts, the latent image does not change from a negative image to a positive image or from a positive image to a negative image depending on the observation angle or observation direction. Hence, the anti-forgery effect is insufficient.

SUMMARY OF THE INVENTION

The present invention has been made in consideration of the above situation, and has as its object to propose authenticity determinable printed matter which can prevent the ink layer thickness from being more than necessary, prevent any increase in number of steps by omitting a process such as embossing, eliminate the influence on the lower surface of the printed matter, and solve the problem that the visual embossing effect is lost by a pressure, and a method of manufacturing the printed matter.

According to the present invention, there is provided authenticity determinable printed matter in which a background image portion and at least one message image portion are printed on a surface of a base member, characterized in that the background image portion has a first line drawing which is arrayed in a first direction and printed by an ink with a specular gloss to have an ink layer thickness, and the message image portion has a second line drawing which is arrayed in a second direction and printed by the ink with the specular gloss to have the ink layer thickness.

Preferably, when the printed matter is observed from a direction in which a total light amount as a sum of a specular reflection light amount and a diffusion light amount in the first line drawing substantially equals that in the second line drawing, the message image is rarely visually recognized, when the printed matter is observed from a direction in which the total light amount in the first line drawing is different from that in the second line drawing, the message image is visually recognized, when an observation angle is changed, a lightness and/or color of the message image continuously changes, when the total light amount in the first line drawing is larger than that in the second line drawing, the background image portion has a higher lightness than the message image portion, and the message image portion is visually recognized as a positive image, and when the total light amount in the second line drawing is larger than that in the first line drawing, the message image portion has a higher lightness than the background image portion, and the message image portion is visually recognized as a negative image.

Each of the background image portion and the message image portion may be screen-printed by the ink with the specular gloss.

Each of the first line drawing and the second line drawing may contain a straight line pattern and/or a curved straight line pattern.

An image line width in each of the first line drawing and the second line drawing preferably falls within a range of 30 to 1,000 μm.

An ink layer thickness in each of the first line drawing and the second line drawing preferably falls within a range of 10 to 150 μm.

The ink used to print the first line drawing and the second line drawing is preferably one of a UV curing ink and an electron radiation curing ink.

The ink used to print the first line drawing and the second line drawing preferably contains at least one of a scaly pigment, a metal powder pigment, glass flakes, and a cholesteric liquid crystal pigment.

A surface treatment for causing the ink to have water- and oil-repellent properties is preferably executed for the ink to improve planar orientation of one of the scaly pigment, the metal powder pigment, the glass flakes, and the cholesteric liquid crystal pigment.

According to the present invention, there is also provided a method of manufacturing authenticity determinable printed matter which has a background image portion and at least one message image portion on a surface of a base member, characterized by comprising printing a first line drawing contained in the background image portion by using an ink with a specular gloss to make the first line drawing arrayed in a first direction and have an ink layer thickness, and printing a second line drawing contained in the message image portion by using the ink with the specular gloss to make the second line drawing arrayed in a second direction and have the ink layer thickness.

According to the present invention, there is also provided authenticity determinable printed matter in which a first image is printed on a surface of a base member, and a second image is printed on the first image, characterized in that the first image at least partially has a region where L* in an L*a*b* calorimetric system is not less than 90 when measured by a colorimeter, and the second image has a line drawing which is printed by one of a semitransparent ink having a specular gloss and a semitransparent ink containing a pigment with planar orientation to have an ink layer thickness.

Preferably, when the printed matter is observed from a direction in which a total light amount as a sum of a specular reflection light amount and a diffusion light amount in the first image substantially equals that in the second image, the first image is more clearly visually recognized than the second image, and when the printed matter is observed while gradually changing an angle of the printed matter from the direction in which the total light amount in the first image substantially equals that in the second image to a direction in which the total light amount in the first image is different from that in the second image, the first image gradually becomes hard to visually recognize and then becomes visible again.

The ink used for the second image preferably contains at least one of a scaly pigment, a metal powder pigment, glass flakes, and a cholesteric liquid crystal pigment.

Preferably, the second image contains a background image portion and at least one message image portion, the line drawing contains a first line drawing contained in the background image portion and a second line drawing contained in the message image portion and having an array direction different from that of the first line drawing, when the printed matter is observed from the direction in which the total light amount as the sum of the specular reflection light amount and the diffusion light amount in the first image substantially equals that in the second image, the background image portion and the message image portion, which are contained in the second image, can rarely visually be identified, and when the printed matter is observed while gradually changing the angle of the printed matter from the direction in which the total light amount in the first image substantially equals that in the second image to the direction in which the total light amount in the first image is different from that in the second image, the message image in the second image changes from a negative image to a positive image or from a positive image to a negative image and is visually recognized, and the first image gradually becomes hard to visually recognize and then becomes visible again.

Each of the first line drawing and the second line drawing can contain a straight line pattern and/or a dot pattern.

An image line width in each of the first line drawing and the second line drawing preferably falls within a range of 30 to 1,000 μm.

An ink layer thickness in each of the first line drawing and the second line preferably drawing falls within a range of 10 to 150 μm.

The ink used to print the first line drawing and the second line drawing may be one of a UV curing ink, an electron radiation curing ink, and a solvent ink.

A surface treatment for causing the ink to have water- and oil-repellent properties is preferably executed for the ink to improve planar orientation of the pigment.

According to the present invention, there is also provided a method of manufacturing authenticity determinable printed matter in which a first image is printed on a surface of a base member, and a second image is printed on the first image, characterized by comprising printing the first image which at least partially has a region where L* in an L*a*b* colorimetric system is not less than 90 when measured by a calorimeter, and printing a line drawing contained in the second image by one of a semitransparent ink having a specular gloss and a semitransparent ink containing a pigment with planar orientation to make the line drawing have an ink layer thickness.

BRIEF DESCRIPTION OF THE DRAWINGS

FIG. 11 is an enlarged plan view showing a state wherein the printed matter according to the first embodiment is observed obliquely at a small angle;

FIG. 12 is an enlarged plan view showing a state wherein the printed matter according to the first embodiment is observed obliquely at a large angle;

FIG. 13 is an explanatory view showing the result of a test for the relationship between an line drawing thickness formed by an ink layer thickness and the visibility of a message image;

FIG. 30 is an explanatory view showing the result of a test for the visibility of a message image, which is obtained while changing the ink layer thickness of an ink (cyan) of an image line in the second image;

FIG. 31 is an explanatory view showing the result of the test for the visibility of a message image, which is obtained while changing the ink layer thickness of an ink (yellow) of an image line in the second image;

FIG. 32 is an explanatory view showing the result of the test for the visibility of a message image, which is obtained while changing the ink layer thickness of an ink (magenta) of an image line in the second image;

FIG. 33 is an explanatory view showing the result of the test for the visibility of a message image, which is obtained while changing the ink layer thickness of an ink (green) of an image line in the second image;

FIG. 34 is an explanatory view showing the result of the test for the visibility of a message image, which is obtained while changing the ink layer thickness of an ink (black) of an image line in the second image;

FIG. 35 is an explanatory view showing the result of a test for the visibility of a message image, which is obtained while changing the lightness (cyan) of the first image;

FIG. 36 is an explanatory view showing the result of a test for the visibility of a message image, which is obtained while changing the lightness (yellow) of the first image;

FIG. 37 is an explanatory view showing the result of a test for the visibility of a message image, which is obtained while changing the lightness (magenta) of the first image;

FIG. 38 is an explanatory view showing the result of a test for the visibility of a message image, which is obtained while changing the lightness (green) of the first image;

FIG. 39 is an explanatory view showing the result of a test for the visibility of a message image, which is obtained while changing the lightness (black) of the first image; and FIG. 40 is an explanatory view showing the result of a test for the visibilities of a background image portion and a message image portion in the second image, which is obtained while changing the image line pitch.

DESCRIPTION OF THE PREFERRED EMBODIMENTS

Authenticity determinable printed matter according to each embodiment of the present invention and a method of manufacturing the same will be described below with reference to the accompanying drawings.

Figure 1:
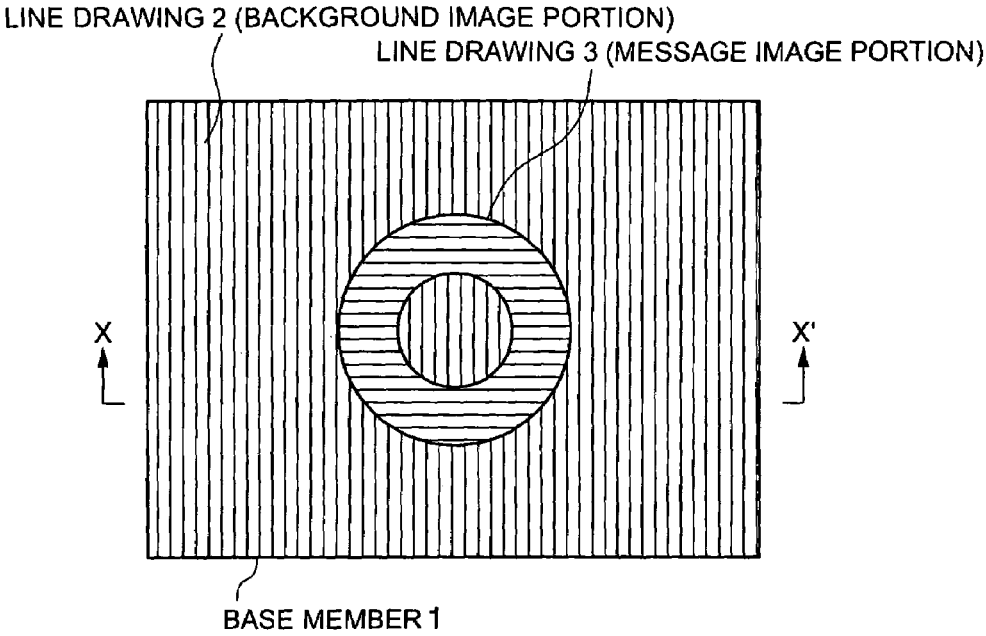
FIG. 1 is an enlarged plan view showing the line drawing structure of printed matter according to the first embodiment of the present invention.
Figure 2:
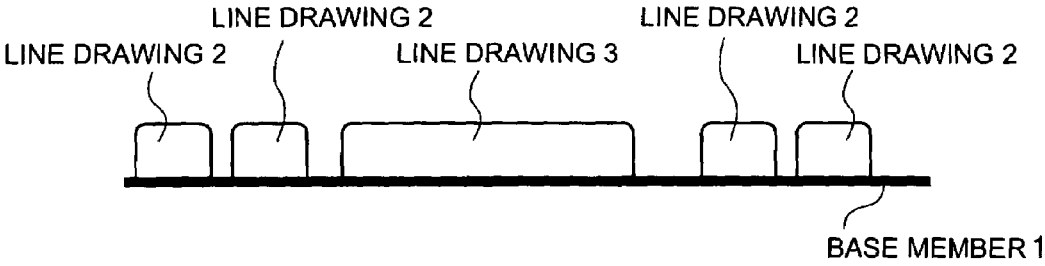
FIG. 2 is an enlarged sectional view showing a longitudinal section taken along a line X-X' in FIG. 1.

FIG. 1 is an enlarged view showing printed matter obtained by printing, on a base member 1, a line drawing 2 that forms a background image portion and has a thickness and a line drawing 3 that forms a message image portion and has a thickness using inks having specular gloss. FIG. 2 is an enlarged longitudinal sectional view taken along a line X-X' in FIG. 1. As shown in FIG. 2, the line drawings 2 and 3 have thicknesses.

This printed matter is observed from a direction perpendicular to it and, more exactly, from a direction in which the total light amount as the sum of the specular reflection amount and diffusion light amount in the line drawing 2 almost equals that in the line drawing 3. Both the background image portion formed by the line drawing 2 and the message image portion formed by the line drawing 3 are printed by using thin line drawings and are hardly influenced by reflection of light. Hence, both line drawings are visually recognized as an almost solid printing region. As a result, appearance of a latent image due to the difference in line drawing array direction between the background image portion and the message image portion does not occur.

When the printed matter should be visually recognized as solid printed matter when it is observed from the direction in which the total light amount in the line drawing 2 almost equals that in the line drawing 3, the image line width in each of the line drawings 2 and 3 preferably falls within the range of, e.g., 30 to 1,000 μm. More preferably, the image line width falls within the range of 60 to 200 μm.

When the printed matter is observed obliquely and, more, exactly, from a direction in which the total light amount as the sum of the specular reflection amount and diffusion light amount in the line drawing 2 is different from that in the line drawing 3, a message image appears. At least one of the light and dark patterns and color of the message image continuously changes at a certain observation angle. The message image appears while changing from a negative image to a positive image or from a positive image to a negative image.

When the line drawing 2 of the background image portion and the line drawing 3 of the message image portion are formed by using a straight line pattern or/and a curved straight line pattern, the light amount of reflected light largely changes between the background image portion and the message image portion in the observed obliquely printed matter. Accordingly, the lightness difference between the background image portion and the message image portion becomes large. Hence, the visibility of the latent image in the message image portion increases.

In the line drawings 2 and 3, the image lines and non-image lines are preferably formed at an equal interval. The angle made by the array direction of the line drawing 2 of the background image portion and that of the line drawing 3 of the message image portion preferably falls within the range, of 30° to 150°. When the angle of the array direction of the line drawing 2 of the background image portion is defined as 0°, the angle of the array direction of the line drawing 3 of the message image portion is preferably almost 90°.

When the basic image has three message image portions, and the angle of the array direction of the line drawing 2 of the background image portion is defined as 0°, the angles of the array directions of the line drawings 3 of the message image portions may be set to 45°, 90°, and 135°.

Alternatively, when the width of each image line in the line drawing 2 of the background image portion and the line drawing 3 of the message image portion is changed stepwise and/or continuously, a latent image having an arbitrary tone level is expressed when the printed matter is tilted. This further increases the anti-forgery effect.

As described above, the line drawings 2 and 3 must have thicknesses (pile up). The ink layer thickness of each of the line drawings 2 and 3 preferably falls within the range of, e.g., 10 to 150 μm. If the ink layer thickness is smaller than 10 μm, the message image portion hardly clearly appears even when the printed matter is observed at an angle. Conversely, when the ink layer thickness of the line drawings 2 and 3 exceeds 150 μm, the printed matter can hardly be manufactured although the latent image is visible.

The inks to be used to form the line drawing 2 of the background image portion and the line drawing 3 of the message image portion only need to have a specular gloss. The types of colors are not limited. A transparent ink may also be used. An ink having a specular gloss indicates an ink having a higher light reflection effect than an ink used for printing of normal books.

Figure 3:
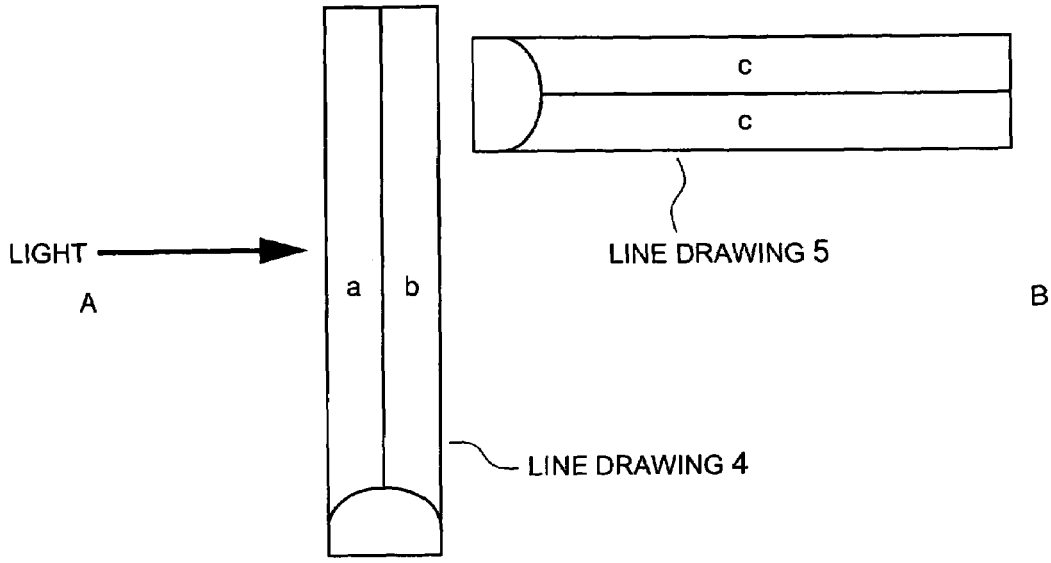
FIG. 3 is an enlarged plan view showing an image line formed by using an ink having a specular gloss in the printed matter according to the first embodiment.

FIG. 3 is an enlarged view showing printed matter that uses an ink having a specular gloss. When this printed matter is irradiated with light from, e.g., a direction A, the light reflection amount from a side surface b of a line drawing 4 having an ink layer thickness and a side surface c of a line drawing 5 change depending on the observation angle, as compared to the light reflection amount from a side surface a of the line drawing 4. Since a lightness difference is generated, the latent image can be confirmed.

To form a line drawing having an ink layer thickness, a UV-curing ink, an electron radiation curing ink, an ink having both a UV curing function and an oxidative polymerization function (Japanese Patent No. 2113880), or a two-part ink can be used. However, it is preferable to use a UV curing ink or electron radiation curing ink. When a UV curing ink is used, the ink must be cured by using active energy rays from a UV ray irradiation apparatus during or after printing.

When the UV curing ink or electron radiation curing ink contains a scaly pigment such as a pearl pigment, a metal powder pigment, or glass flakes or cholesteric liquid crystal pigment, the influence of light reflection increases. In addition, the visual effect unique of each pigment can be obtained. Hence, the message image portion can appear even at a small angle.

Figure 4:
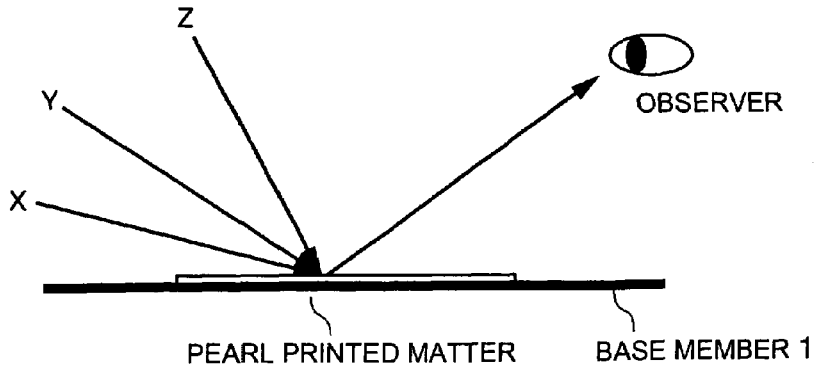
FIG. 4 is an explanatory view schematically showing an optical color change in pearl printed matter printed with a small ink layer thickness by using an ink which contains a scaly pigment such as a pearl pigment and is generally used.

FIG. 4 is a schematic view showing an optical color change in pearl printed matter which is used in general offset printed matter and obtained by using a scaly pigment such as a pearl pigment, and has a small ink layer thickness. In this case, the image observation position is fixed, and the light source position is changed. The color observed when the light source is set at a height X changes when the light source is moved to a height Y. When the light source is further moved to a height Z, the color returns to that when the light source is set at the height X.

Figure 5A:
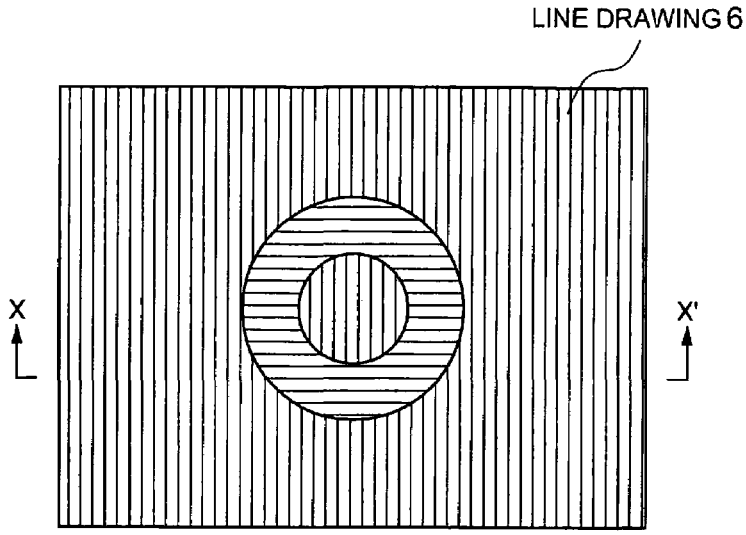
FIG. 5A is an enlarged plan view showing printed matter obtained by using a scaly pigment such as a pearl pigment and combining image lines with a small ink layer thickness.
Figure 5B:
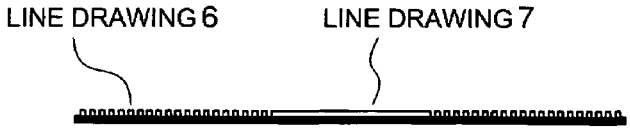
FIG. 5B is an enlarged sectional view showing a longitudinal section taken along a line X-X' in FIG. 5A.

FIG. 5A shows printed matter obtained by using a scaly pigment such as a pearl pigment and combining image lines with a small ink layer thickness. FIG. 5B is an enlarged longitudinal sectional view taken along a line X-X' in FIG. 5A. As described above, when the printed matter is irradiated with light while the viewpoint for the printed matter is fixed, and the light source position is changed, line drawings 6 and 7 change their colors at the same timing.

Figure 6:
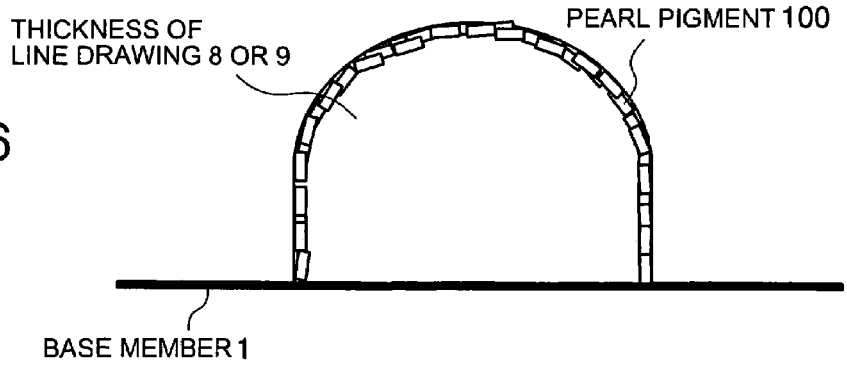
FIG. 6 is an enlarged sectional view showing the distribution of the scaly pigment that has undergone surface processing in the first embodiment.

As the pearl pigment, for example, an iridescent pearl pigment, two-part pearl pigment, or any other scaly pigment may be used. Although a pearl pigment can be used, a process for orientating the pigment on the surface of the line drawing with an ink layer thickness is preferably executed to further increase the orientation effect (leafing effect) of the scaly pigment. More specifically, a surface treatment such as water- and oil-repellent processes disclosed in, e.g., Japanese Patent Laid-Open No. 2001-106937 is executed. With this process, a pigment 100 can be orientated on the surface of the printed matter, as shown in FIG. 6.

A line drawing having an ink layer thickness as described above must have a quick-curing property. Printing is performed using an ink prepared by mixing, e.g., a UV-curing ink, an electron radiation curing ink, an ink having both a UV curing function and an oxidative polymerization function, or a two-part ink with a pigment that has undergone the surface treatment (water- and oil-repellent processes). After printing, the printed matter is irradiated with active energy rays from a UV irradiation apparatus or the like. With this process, the pigment does not settle even when a line drawing having an ink layer thickness is formed. The pigment can be orientated on the surface of the image line, as shown in FIG. 6.

If the water- and oil-repellent processes are not executed, the ink cures before the scaly pigment is orientated. For this reason, no pearl effect is obtained. Even when the pearl effect is obtained, the visual recognition effect is often poor as compared to a pigment that has undergone the water- and oil-repellent processes.

The particle size of the pearl pigment is, e.g., 1 to 150 μm. The particle size is preferably 5 to 50 μm. The average particle size is preferably about 10 to 25 μm.

Figure 7:
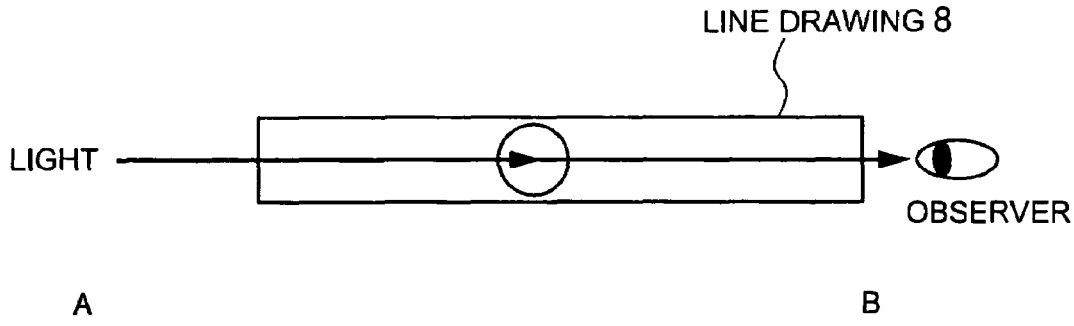
FIG. 7 is an enlarged explanatory view showing a state wherein printed matter is obtained by printing a line drawing 5 shown in FIG. 3 by using a scaly pigment that has undergone a water-repellent process, and the printed matter is irradiated with light from a direction A and observed from a direction B.

The line drawing 5 shown in FIG. 3 is printed by using a scaly pigment that has undergone the water- and oil-repellent processes. FIG. 7 is an enlarged view showing a state wherein a line drawing 8 thus obtained is irradiated with light from the direction A and observed from the direction B. When the viewpoint is fixed, and the light source height is changed, the color changes in the line drawing 8 at the same timing as in a line drawing with a small ink layer thickness.

Figure 8:
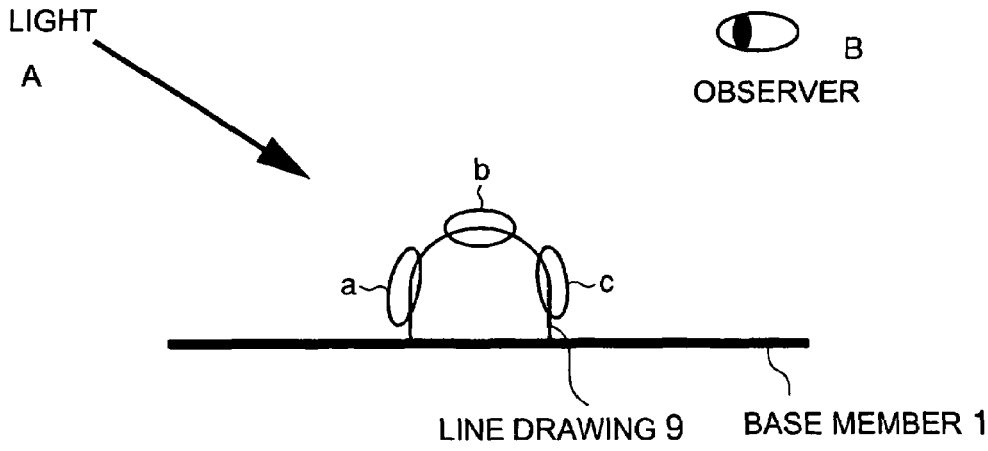
FIG. 8 is an enlarged explanatory view showing a state wherein printed matter is obtained by printing a line drawing 4 shown in FIG. 3 by using a scaly pigment that has undergone a water-repellent process, and the printed matter is irradiated with light from the direction A and observed from the direction B.

In a similar manner, the line drawing 4 shown in FIG. 3 is printed by using a scaly pigment that has undergone the water- and oil-repellent processes. FIG. 8 is an enlarged view showing a state wherein a line drawing 9 thus obtained is irradiated with light from the direction A and observed from the direction B. The line drawing 9 is three-dimensional because its image line has a large ink layer thickness. First, when the color changes on the side surface a, the latent image can be confirmed. When the light irradiation angle is changed, the color on the side surface b changes. Even the line drawing 8 shown in FIG. 7 also changes its color at this timing. For this reason, the message image portion and background image portion cannot be discriminated. When the light irradiation angle is further changed, the color on the side surface c shown in FIG. 8 changes, and the latent image can be confirmed again. That is, in the line drawing 9 shown in FIG. 8, the color change continuously repeatedly occurs. Hence, the color change timing shifts or matches between the line drawing 9 and the line drawing 8 shown in FIG. 7 in which the color changes only once. Hence, disappearance and appearance of the image become conspicuous. When the color change continuously repeatedly occurs, the angle of color change occurrence can be made large.

The printing method used in the first embodiment is not limited as long as an ink layer thickness can be set. For example, screen printing may be used. No special adjustment is necessary in adjusting the printing press. Printing can be executed on the basis of general settings.

As the base member in the first embodiment, various kinds of materials can be used, including paper sheets, plastic films, metals, and cloth.

Some detailed examples manufactured in accordance with the first embodiment will be described below in more detail. However, the present invention is not limited to these examples.

EXAMPLE 1

Figure 9:
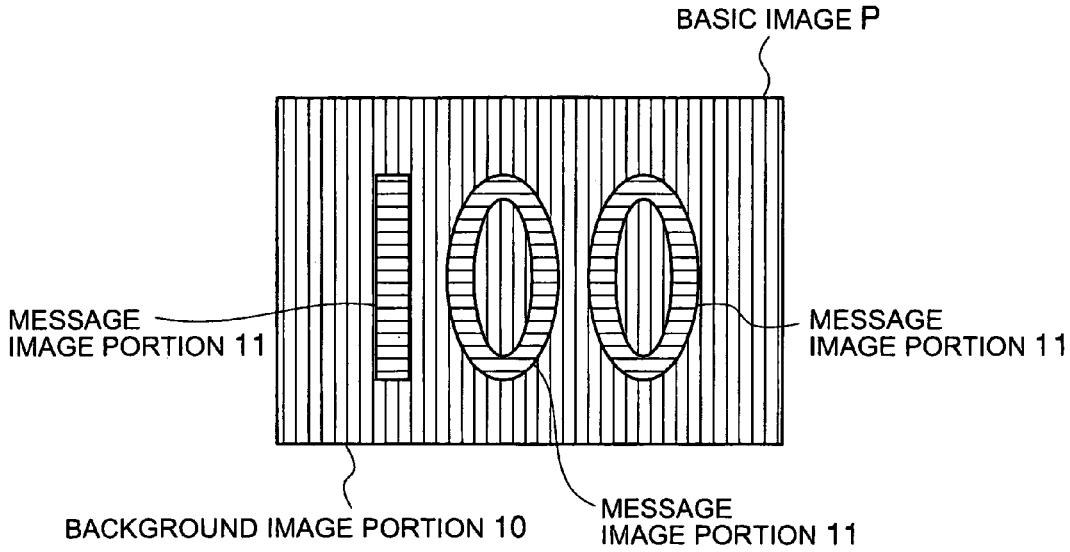
FIG. 9 is an enlarged plan view showing the basic structure of the printed matter according to the first embodiment.

FIG. 9 is an enlarged view of a basic image P in Examples 1 and 2. The basic image P is formed from a line drawing with a pitch of 200 μm and an image line width of 100 μm. The basic image P is divided into a background image portion 10 and a message image 11 having a latent image. When the angle of the array direction of the line drawing of the background image portion 10 is 0°, that of the message image 11 is 90°.

A screen printing plate to be used to print the basic image P was prepared. An ink was prepared at the following mixing ratio.

Composition of Screen Printing Ink

| | |
|---|---|
| Pigment ($SiO_2$: silica powder) | 10 parts by weight |
| Urethane acrylate (UX-4101 available from Nippon Kayaku) | 50 parts by weight |
| Monomer (PEG-400DA available from Nippon Kayaku) | 30 parts by weight |
| Initiator (Irgacure819 available from Ciba Specialty Chemicals) | 9 parts by weight |
| Inhibitor (Methylhydroquinone available from Tokyo Kasei Kogyo) | 0.5 parts by weight |
| Antifoaming agent (SC5540 available from Toray Dow Corning Silicone) | 0.5 parts by weight |

Printing was executed by a screen printing press using the obtained screen printing plate and screen ink. The ink was cured by a UV ray irradiation apparatus, thereby obtaining printed matter of Example 1.

Figure 10:
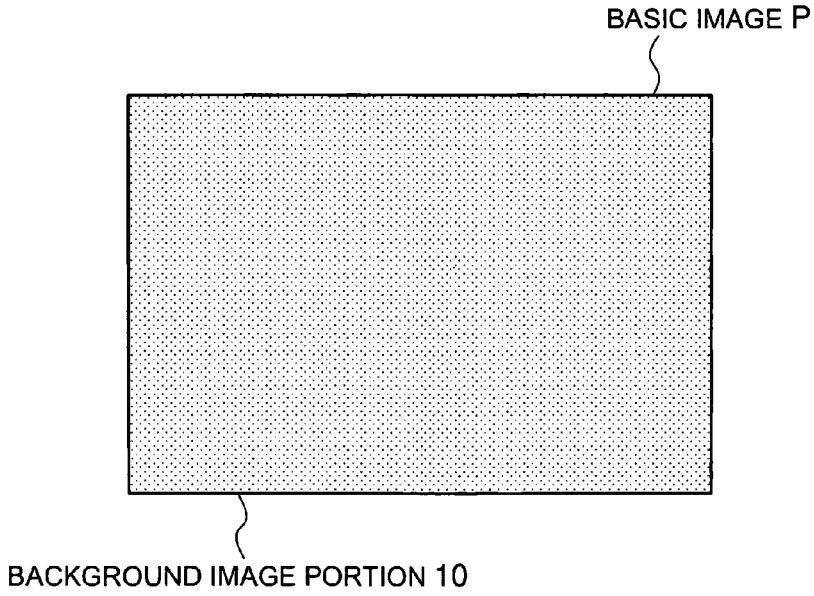
FIG. 10 is an enlarged plan view showing a state wherein the printed matter is observed straight from the upper side.

FIG. 10 shows a state wherein the printed matter of Example 1 is observed straight from the upper side (more exactly, from a direction in which the total light amount as the sum of the specular reflection amount and diffusion light amount in the line drawing in the message image almost equals that in the line drawing in the background image). As shown in FIG. 10, when the printed matter was observed straight from the upper side, the basic image P was visually recognized as an almost solid printing region. The message image 11 could rarely be visually recognized.

FIG. 11 shows a state wherein the printed matter of Example 1 is observed at a small angle (more exactly, from a direction in which the total light amount as the sum of the specular reflection amount and diffusion light amount in the line drawing in the message image is different from that in the background image). A lightness difference was generated between the background image portion 10 and the message image 11. The message image 11 was visually recognized as a positive image so that the message image could visually be recognized. In this case, the total light amount is smaller in the background image portion 10 than in the message image 11.

FIG. 12 shows a state wherein the printed matter of Example 1 is observed at a larger angle (more exactly, from a direction in which the total light amount as the sum of the specular reflection amount and diffusion light amount in the line drawing in the message image is different from that in the background image). A lightness difference was generated between the background image portion 10 and the message image 11. In this case, the message image 11 was visually recognized as a negative image so that the message image could visually be recognized. In this case, the total light amount is larger in the background image portion 10 than in the message image 11.

As described above, when the angle of the printed matter was gradually changed from a shallow angle to a deep angle, the background image portion 10 gradually changed from a negative image to a positive image or from a positive image to a negative image. On the other hand, the message image 11 changed from a positive image to a negative image or from a negative image to a positive image. Hence, the message image 11 could visually be recognized.

EXAMPLE 2

Printed matter according to Example 2 was prepared in accordance with the same procedures as in Example 1 except that an ink used was prepared at the following mixing ratio that was different from Example 1.

Composition of Screen Printing Ink

| | |
|---|---|
| Scaly pigment (Pearl pigment with high orientation available from Merck Japan) | 20 parts by weight |
| Urethane acrylate (UX-4101 available from Nippon Kayaku) | 40 parts by weight |
| Monomer (PEG-400DA available from Nippon Kayaku) | 30 parts by weight |
| Initiator (Irgacure819 available from Ciba Specialty Chemicals) | 9 parts by weight |
| Inhibitor (Methylhydroquinone available from Tokyo Kasei Kogyo) | 0.5 parts by weight |
| Antifoaming agent (SC5540 available from Toray Dow Corning Silicone) | 0.5 parts by weight |

When the printed matter according to Example 2 was observed straight from the upper side, it was visually recognized as a uniform almost solid printing region, like the printed matter according to Example 1. The message image 11 could not visually be recognized. However, when the printed matter was observed obliquely, color changes occurred in the background image portion 10 and message image 11. A lightness difference larger than in the printed matter of Example 1 was generated. Hence, the message image 11 could more clearly visually be recognized.

Next, printed matter samples according to several reference examples were prepared to determine whether ink layer thicknesses were appropriate. The visibility of each message image portion was tested by tilting and observing the resultant printed matter samples. The message images were rated on a 1-to-3 scale. A message image whose change from a negative image to a positive image could clearly be recognized was rated ○. A message image whose change could be recognized but not clearly was rated Δ. A message image that could hardly be identified or could not be identified at all was rated ×. FIG. 13 shows the evaluation result.

REFERENCE EXAMPLE 1

Printed matter (of solvent dry type) according to Reference Example 1 was prepared in accordance with the same procedures as in Example 1 except that an ink used was prepared at the following mixing ratio.

Composition of screen printing ink

| | |
|---|---|
| Scaly pigment<br>Pigment as in Example 2<br>(pearl pigment with high orientation<br>available from Merck Japan) | 20 parts by weight |
| Solvent type varnish<br>(SG720 available from Seiko Advance) | 79.5 parts by weight |
| Antifoaming agent<br>(SC5540 available from Toray<br>Dow Corning Silicone) | 0.5 parts by weight |

When the printed matter of Reference Example 1 was observed obliquely, no message image could visually be recognized.

REFERENCE EXAMPLE 2

Printed matter according to Reference Example 2 was obtained by an offset printing method using ink as in Example 1. When the printed matter of Reference Example 2 was observed obliquely, no message image could visually be recognized.

As described above, according to the authenticity determinable printed matter of the above embodiment and examples and the method of manufacturing the same, no message image is confirmed when the printed matter is observed straight from the upper side. When the printed matter is observed obliquely, the message image becomes visible at a shallow observation angle. At a deeper observation angle, the message image changes from a negative image to a positive image or from a positive image to a negative image. Hence, ordinary people can easily determine the authenticity without using any expensive authenticity determination apparatus.

In addition, the ink layer thickness need not be more than necessary. Since a process such as embossing is not executed, the influence on the lower side of the printing surface can be eliminated. The problem that the visual recognition effect is lost by a pressure can be solved. Since the two steps of printing and embossing are unnecessary, the operation efficiency can be increased.

Furthermore, when printed matter with an ink layer thickness is manufactured by using an ink containing a pearl pigment or the like, the optical effect can be maintained. The timing of a change in color and/or lightness in the background image portion is shifted from that in the message image portion. The degree of the change of the message image from a negative image to a positive image or from a positive image to a negative image becomes conspicuous depending on the observation angle. Hence, a higher antiforgery effect can be obtained.

Printed matter according to the second embodiment of the present invention will be described with reference to the accompanying drawings. The printed matter according to the second embodiment has a first image printed on a base member and a second image printed on the first image, as will be described later.

An ink used for the second image, which has a specular gloss or contains a pigment with a planar orientation, will be described. An ink having a specular gloss is an ink having a higher light reflection effect than an ink used for printing of normal books, i.e., an ink with a large reflection light amount, as described above. The materials and mixture of the ink are not particularly limited as long as the ink can ensure a large reflection light amount. In this embodiment, a semitransparent ink or a semitransparent ink containing a color pigment is preferably used.

When a semitransparent ink that contains a color pigment having the same or almost the same hue as that of the underlying first image (to be described later) is used, the effect for making the latent image of the first image invisible can be improved. However, a semitransparent ink that does not contain such a color pigment may be used.

Figure 14:
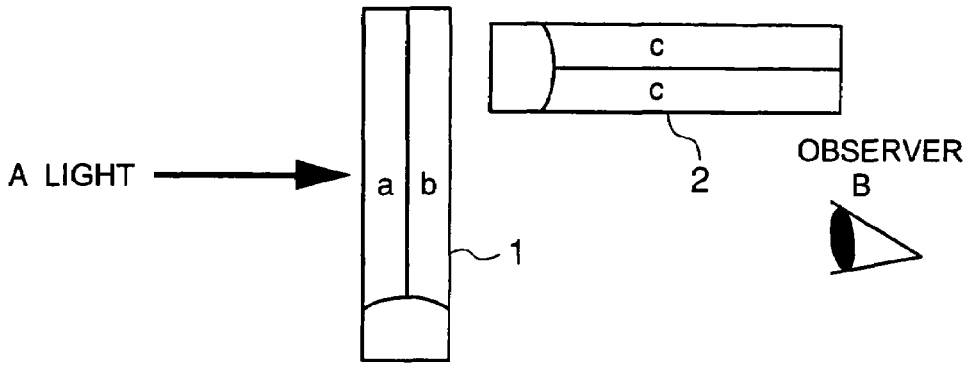
FIG. 14 is an enlarged plan view showing the line drawing structure of printed matter according to the second embodiment of the present invention.

FIG. 14 is an enlarged plan view showing image lines 1 and 2 each of which is printed by using an ink having a specular gloss such that an ink layer thickness is obtained. A case in which the printed matter is irradiated with light from a direction A and observed from a direction B in FIG. 14 will be examined.

The light reflection amounts from a side surface b of the image line 1 and a side surface c of the image line 2 change with respect to the light reflection amount from a side surface a of the image line 1 depending on the observation angle. Accordingly, a lightness difference is generated between the image line 1 and the image line 2. Hence, when the printed matter, in which the line drawing array direction of the background image portion and that of the message image portion are changed between the image line 1 and the image line 2, is tilted and observed, a lightness difference is generated between the background image portion and the message image portion, or the lightness difference is inverted depending on the tilt angle of the printed matter. Hence, the message image portion can be identified.

Figure 15A:
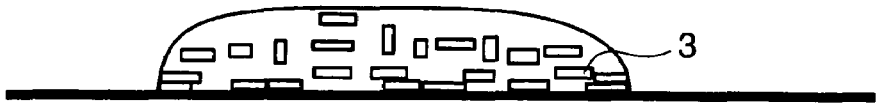
FIG. 15A is an enlarged sectional view showing a pigment distribution state in a coating of an ink containing a pigment having no planar orientation.
Figure 15B:
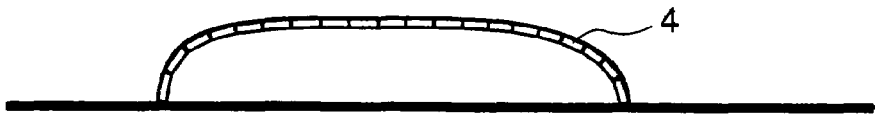
FIG. 15B is an enlarged sectional view showing a pigment distribution state in a coating of an ink containing a pigment having planar orientation.

FIG. 15A is an enlarged view showing a pigment distribution state in an ink coating printed by using an ink containing a pigment having no planar orientation. FIG. 15B is an enlarged view showing a pigment distribution state in an ink coating printed by using an ink containing a pigment having planar orientation.

When the coating is printed by using an ink containing a pigment 3 having no planar orientation, the pigment 3 is orientated at random in the entire ink coating, as shown in FIG. 15A. When the coating is printed by using an ink containing a pigment 4 having planar orientation, the pigment 4 is orientated along the surface of the ink coating, as shown in FIG. 15B.

When water- and oil-repellent processes disclosed in, e.g., Japanese Patent Laid-Open No. 2001-106937 is executed for the pigment, such planar orientation (leafing effect) is obtained. A pigment having water- and oil-repellent properties hardly settles down in the ink coating and is orientated along the upper surface of the ink coating.

On the other hand, a pigment that has not undergone the water- and oil-repellent processes has no planar orientation. The ink dries before the pigment is orientated. Hence, the pigment is orientated at random in the coating.

As the pigment having planar orientation in this embodiment, a pearl pigment, scaly pigment, metal powder pigment, or glass flakes or cholesteric liquid crystal pigment is preferably used. When such an optical change pigment is used, light can readily be reflected, and an effect unique to the pigment can be obtained. A larger lightness difference is generated between the background image portion and the message image portion of the second image. Accordingly, the message image can more clearly appear. It appears even when the printed matter is tilted at a shallow angle. Hence, an effect for preventing any copy by using a copying machine or image input device can be obtained.

Figure 16:
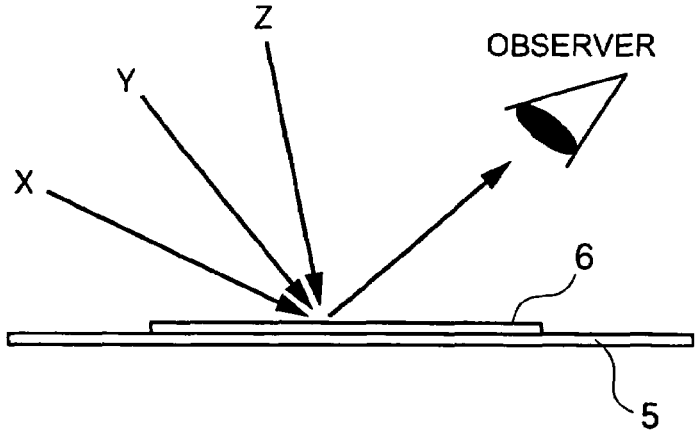
FIG. 16 is an explanatory view schematically showing an optical color change in pearl printed matter printed with a small ink layer thickness.

FIG. 16 is a schematic view showing an optical color change in pearl printed matter obtained by using a scaly pigment such as a pearl pigment with a small ink layer thickness, which is represented by general offset printed matter.

The observation position is fixed with respect to an image 6 printed on a base member 5 by using an ink containing a pearl pigment. The height of the light source is changed to X, Y, and Z. The color recognized when the image is irradiated with light from the height X changes when the height of the light source is changed to Y. When the light source is further moved to the height Z, the color returns to that observed when the image is irradiated with light from the height X. The interference light of an optical change pigment such as a pearl pigment changes depending on the refractive index, shape, thickness, size, and the pigment distribution in the ink coating.

As the pearl pigment, an iridescent pearl pigment, two-part pearl pigment, or any other scaly pigment may be used. The particle size of the pearl pigment is, e.g., 1 to 150 μm, and preferably, 5 to 50 μm. The average particle size is preferably about 10 to 15 μm.

Figure 17A:
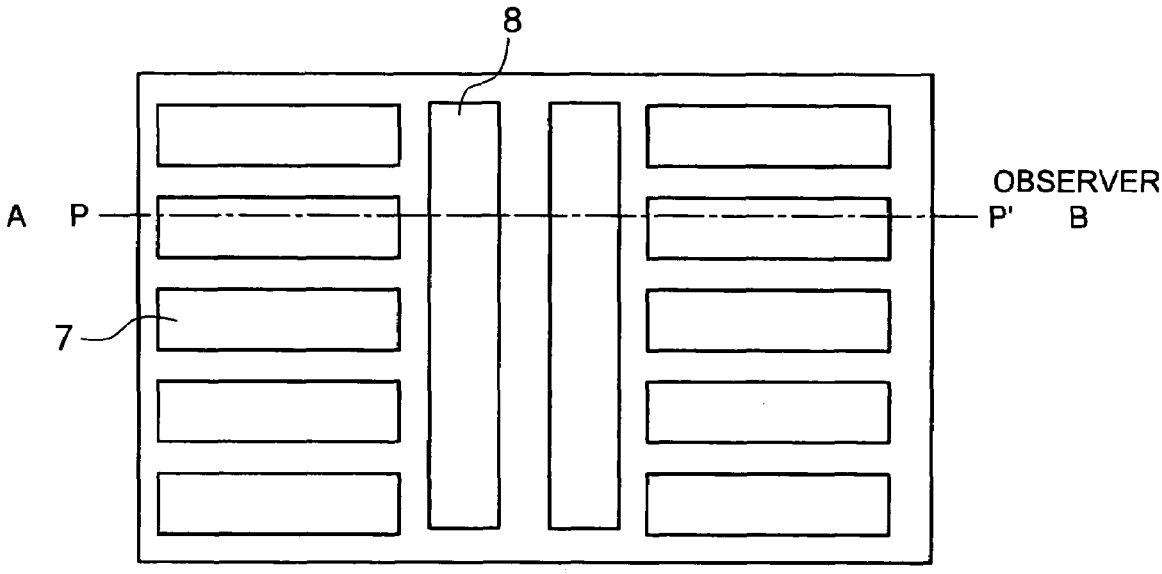
FIG. 17A is a plan view showing printed matter obtained by printing image lines 7 and 8 by using an ink containing a scaly pigment that has undergone water- and oil-repellent processes to obtain planar orientation.
Figure 17B:
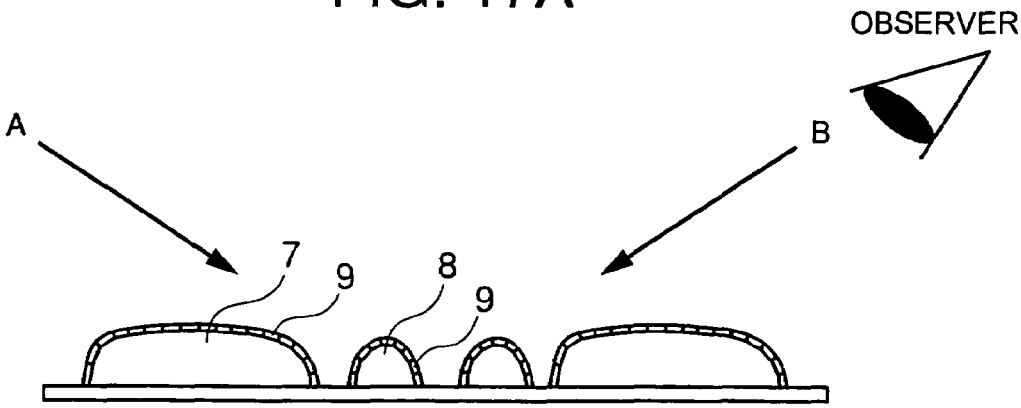
FIG. 17B is a sectional view showing a longitudinal section taken along a line P-P' in FIG. 17A.

FIG. 17A shows printed matter obtained by printing image lines 7 and 8 by using an ink containing a scaly pigment that has undergone water- and oil-repellent processes to obtain planar orientation. As shown in FIG. 17B that is a longitudinal sectional view taken along a line P-P' in FIG. 17A, a scaly pigment 9 exhibits planar orientation (leafing effect) along the upper surfaces of the ink coatings of the image lines 7 and 8.

When the second image is printed by using an ink containing a scaly pigment that has undergone the water- and oil-repellent processes to obtain planar orientation, the message image can be made visible more clearly.

As described in the first embodiment, an image line having an ink layer thickness must have a quick-curing property Hence, printing is performed by using an ink prepared by causing a UV-curing ink, an electron radiation curing ink, an ink having both a UV curing function and an oxidative polymerization function, or a two-part ink to contain a pigment that has undergone the surface treatment (water- and oil-repellent processes). After printing, the printed matter must be irradiated with active energy rays from a UV ray irradiation apparatus or the like.

With this arrangement, even when an image line having an ink layer thickness is formed, the pigment does not settle. The scaly pigment 9 exhibits planar orientation (leafing effect) along the upper surface of the ink coating of each of the image lines 7 and 8, as shown in FIG. 17B. Hence, a visual recognition effect can be obtained.

If the water- and oil-repellent processes are not executed, the ink cures before the pigment is orientated. For this reason, no pearl effect is obtained. Even when the pearl effect is obtained, the visual recognition effect is poor as compared to a pigment that has undergone the water- and oil-repellent processes.

Figure 18:
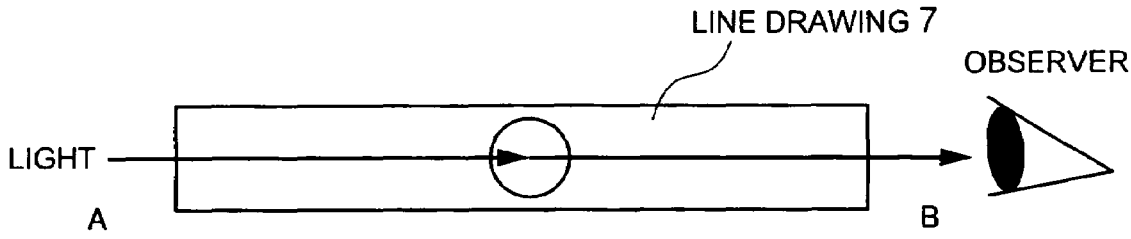
FIG. 18 is an enlarged plan view showing a state wherein the image line 7 shown in FIG. 17A is printed by using the scaly pigment that has undergone the water- and oil-repellent processes, and the image line 7 is irradiated with light from the direction A and observed from the direction B.

FIG. 18 is an enlarged view showing a state wherein the image line 7 printed by using an ink containing a scaly pigment that has undergone the water- and oil-repellent processes is irradiated with light from the direction A and observed from the direction B. The viewpoint is fixed, and the height of the light source is changed. In the image line 7, the color changes between the heights X, Y, and Z at the same timing as described with reference to FIG. 16.

Figure 19:
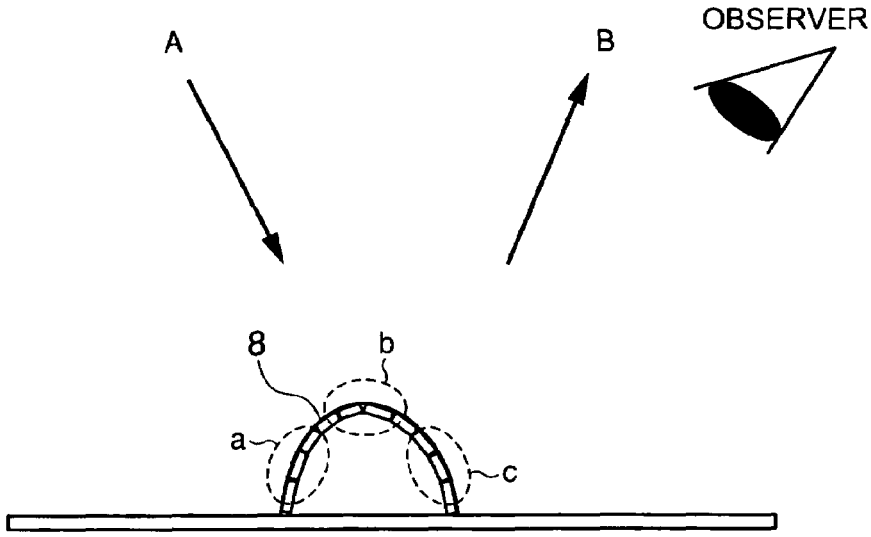
FIG. 19 is an enlarged sectional view showing a state wherein the image line 8 shown in FIG. 17A is printed by using the scaly pigment that has undergone the water- and oil-repellent processes, and the image line 8 is irradiated with light from the direction A and observed from the direction B.

The image line 8 shown in FIGS. 17A and 17B is printed by using a scaly pigment that has undergone the water- and oil-repellent processes and observed from the direction B while being irradiated with light from the direction A, as shown in FIG. 19. This case will be described below.

The image line 8 is three-dimensional because it has a large ink layer thickness. When the image line 8 is irradiated with light from the direction A and observed from the direction B, the wavelength of light reflected by the scaly pigment changes between regions a, b, and c. Hence, different colors are observed in the regions a, b, and c.

When irradiated with light from the direction A and observed from the direction B, the image line 7 that is arranged perpendicularly to the image line 8 exhibits the same color as in the region b of the image line 8. The regions a and c of the image line 8 exhibit colors different from the image line 7. When the angle of light is changed, the image line 7 exhibits the same color as in the region a or c of the image line 8 at a certain angle. In the region b of the image line 8, a color different from that of the image line 7 is observed at a certain angle.

Figure 20A:
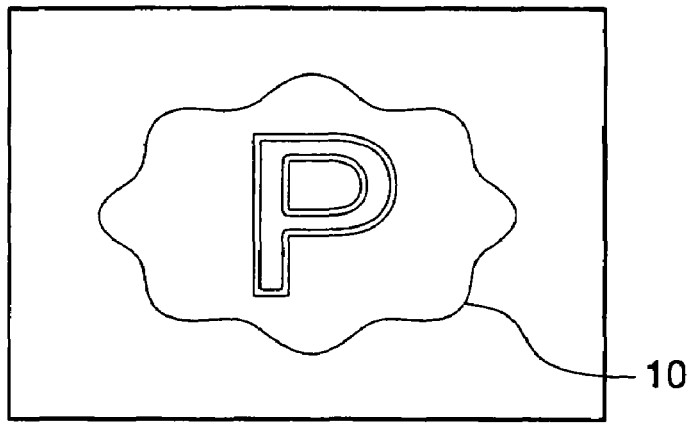
FIGS. 20A, 20B, and 20C are explanatory views showing the visibilities of first and second images when the printed matter according to the second embodiment is observed at various angles.

FIG. 20A shows a first image 10 in the printed matter of this embodiment. The first image 10 must be printed while totally or partially having a low-density region. From the viewpoint of image pattern, a high-density region may be formed at part of the first image 10. The printing method is not particularly limited. However, an offset printing method is preferable.

In the low-density region where the first image 10 is printed, L* in the L*a*b* calorimetric system must be 90 or more and is preferably 95 or more when measured by a calorimeter. If this value is smaller than 90, the effect for making the first image 10 invisible is lost when the printed matter is continuously tilted and observed straight from the upper side.

Figure 20B:
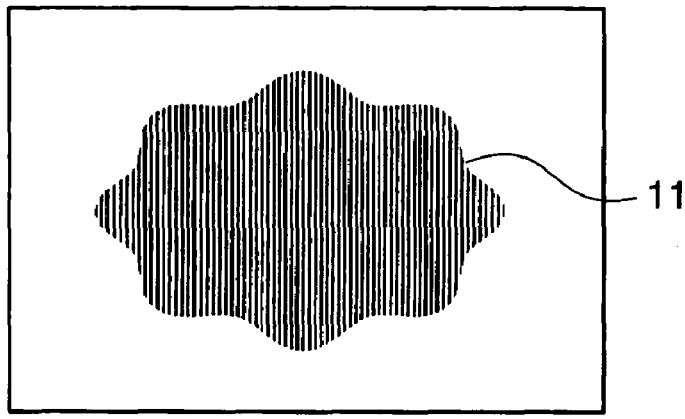

FIG. 20B shows a second image 11. The second image 11 must be formed by a line drawing having an ink layer thickness by using a semitransparent ink having a specular gloss or a semitransparent ink containing a pigment having planar orientation. Hence, a semitransparent ink containing an optical change pigment, a semitransparent ink containing a color pigment, or a semitransparent ink is preferably used. However, the visual recognition effect can be obtained even when a transparent ink is used. More preferably, the visual recognition effect for making the latent image visible or invisible can be improved by using a semitransparent ink having the same or almost the same hue as that of the first image 10. The printing method is not particularly limited. However, an intaglio printing method or a screen printing method is preferable.

Figure 20C:
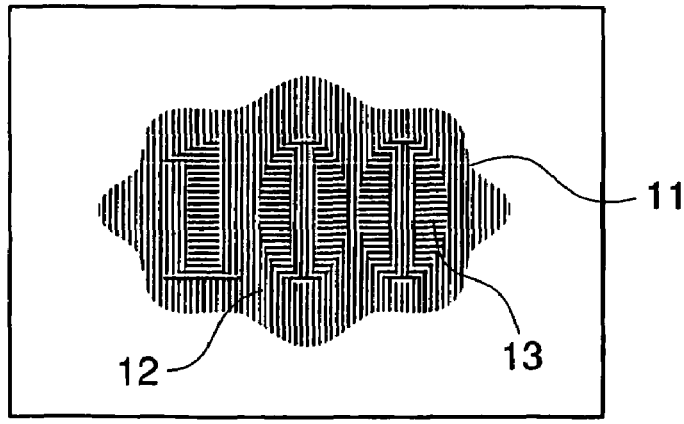

FIG. 20C shows another example of the second image 11. The second image 11 has a background image portion 12 and at least one message image portion 13. The angle of line drawing array direction changes between the background image portion 12 and the message image portion 13. Each image line of the line drawing has an ink layer thickness.

Figure 21:
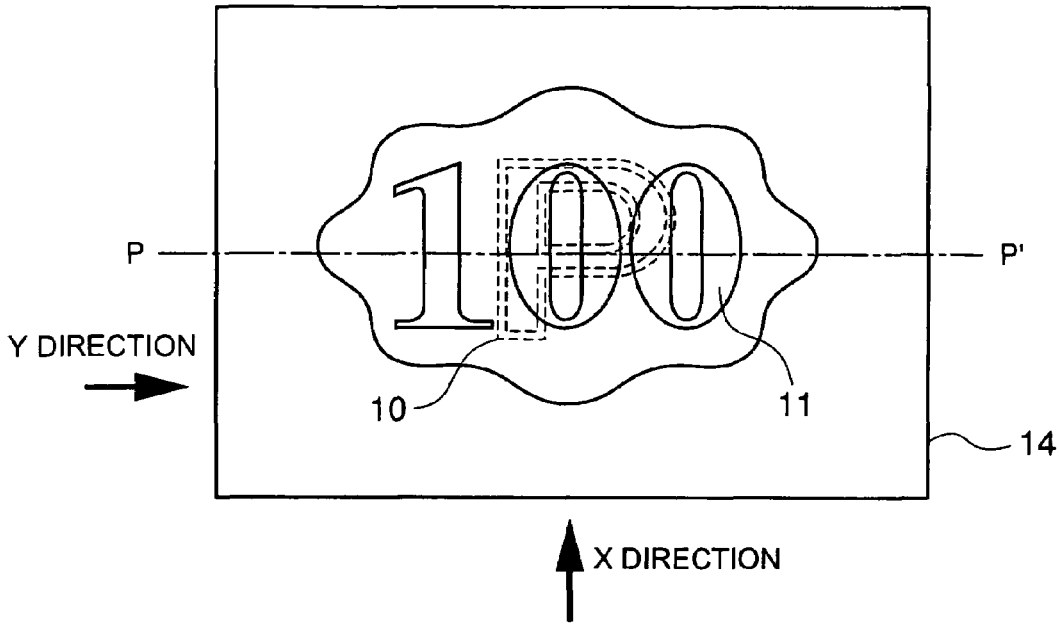
FIG. 21 is a plan view showing an example of the structure of the printed matter according to the second embodiment.

FIG. 21 shows a more detailed structure of the printed matter. The first image 10 shown in FIG. 20A is printed on a base member 14. The second image 11 shown in FIG. 20C is printed on the first image 10. Instead of the second image 11 shown in FIG. 20C, the second image 11 shown in FIG. 20B may be printed.

Figure 22:
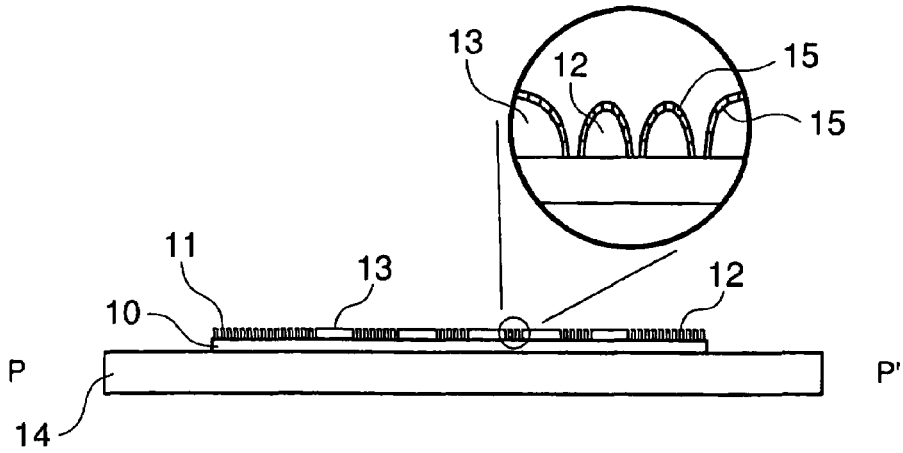
FIG. 22 is an enlarged sectional view showing a section taken along a line P-P' in FIG. 21 when the second image in the printed matter according to the second embodiment is printed by using a semitransparent ink containing an optical change pigment having planar orientation.

FIG. 22 shows a longitudinal section of the printed matter taken along a line P-P' in FIG. 21 and a partial enlarged view when the second image 11 is printed by using a semitransparent ink containing an optical change pigment having planar orientation. The first image 10 is formed on the base member 14. The second image 11 corresponding to the background image is formed on the first image 10. The second image 11 has the line drawing 12 having an ink layer thickness and the line drawing 13 having an ink layer thickness and contained in the message image portion 13.

A pigment 15 which has planar orientation and optically changes, which is contained in each image line of the line drawing 12 having an ink layer thickness and serving as the background image portion 12 and the line drawing 13 having an ink layer thickness and serving as the message image portion 13, is orientated along the upper surface of an ink coating.

Figure 23:
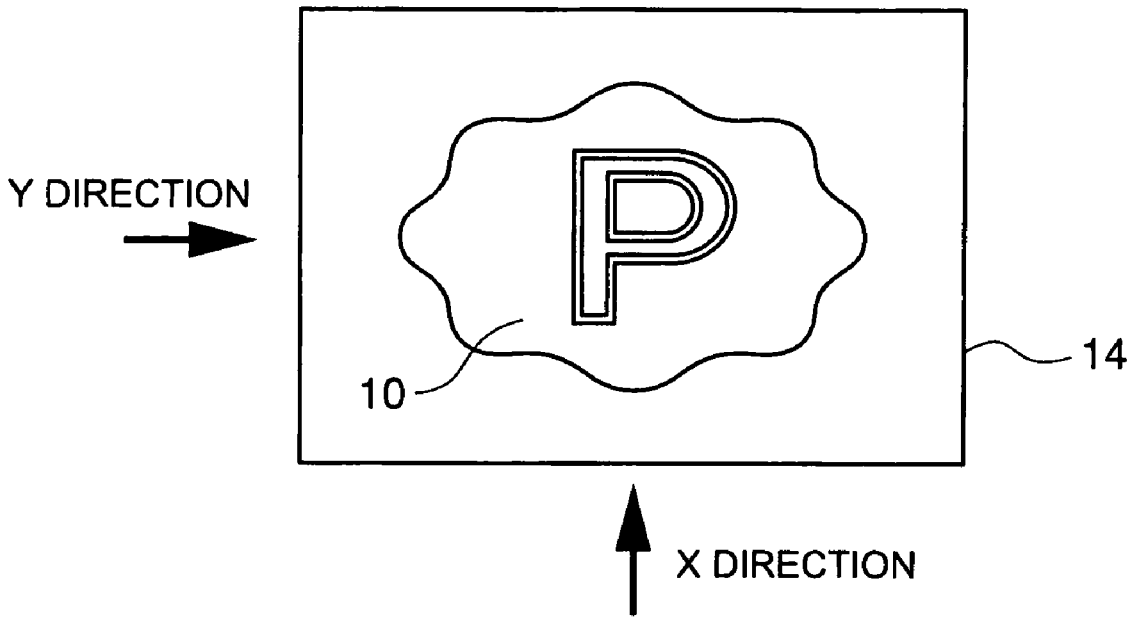
FIG. 23 is a plan view showing the visibilities of the first and second images when the printed matter is observed straight from the upper side.

FIG. 23 shows a state wherein the printed matter shown in FIGS. 21 and 22 is observed straight from the upper side. The background image portion 12 and message image portion 13 in the second image 11 cannot be visually discriminated. Only the first image 10 can be confirmed. The second image 11 formed from line drawing is printed by using a semitransparent ink having a specular gloss or a semitransparent ink containing a pigment with planar orientation. For this reason, incident light is separated into a light component that passes into the ink coating of the second image 11 as transmission light and a light component that causes specular or diffused reflection on the ink coating of the second image 11. The transmission light that passes into the ink coating of the second image 11 becomes the reflected light of the first image 10. Hence, only the first image 10 is visually confirmed.

The line drawing array direction changes between the background image portion 12 and the message image portion 13 in the second image 11. These line drawings are fine line drawings that are hard to visually recognize. In addition, the transmission light amount, diffused reflection light amount, and specular reflection light amount on the ink coating of the background image portion 12 almost equal those on the ink coating of the message image portion 13. For these reasons, the background image portion 12 and message image portion 13 can be made hard to visually identify although the line drawing array directions are different.

The image line width of each of the line drawing of the background image portion 12 and that of the message image portion 13 preferably falls within the range of 30 to 1,000 μm, and more preferably, 60 to 200 μm.

When such fine line drawing is formed, diffused reflection of incident light on the ink coating becomes more conspicuous. It is therefore difficult to discriminate the background image portion 12 from the message image portion 13. As a result, only the first image 10 is confirmed through the second image 11 because the second image 11 is printed on the first image 10 by using a semitransparent ink, as shown in FIG. 23.

FIGS. 24A to 24D show states wherein the printed matter shown in FIG. 22 is tilted continuously and observed from the X direction.

Figure 24A:
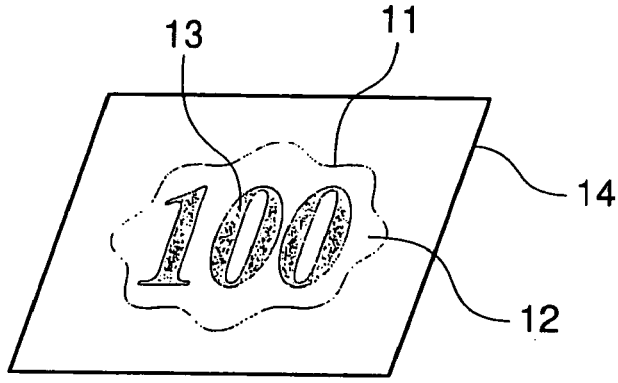
FIGS. 24A, 24B, 24C, and 24D are explanatory views showing the visibilities of the first and second images when the printed matter is observed at various angles in the X direction.

FIG. 24A shows a state wherein the printed matter shown in FIG. 9 is tilted at a shallow angle.

The line drawing array direction changes between the background image portion 12 and the message image portion 13 in the second image 11 shown in FIG. 20C. For this reason, in the background image portion 12 with a vertical array, incident light is confirmed bright because the specular reflection light amount is larger than the transmission light amount and diffused reflection light amount on the ink coating.

On the other hand, in the message image portion 13 with a horizontal array, the transmission light amount and diffused reflection light amount on the ink coating are larger than in the background image portion 12, and the specular reflection light amount is smaller. Hence, the light is confirmed dark.

As a result, the message image portion 13 is confirmed as a positive image. In the background image portion 12 and message image portion 13 in the second image 11, the specular reflection light amount is larger than that obtained when the printed matter is observed straight from the upper side, as shown in FIG. 23. Hence, the color component of the first image 10 is hard to visually recognize. The first image 10 is visually recognized as if it were invisible.

Figure 24B:
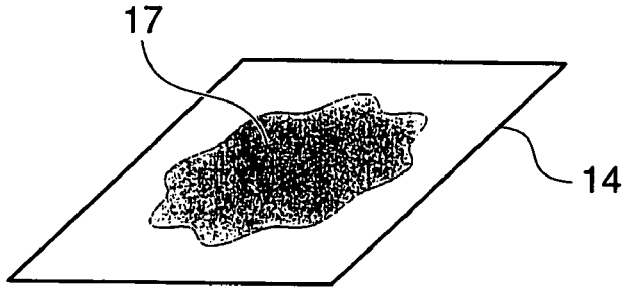

FIG. 24B shows a state wherein the printed matter shown in FIG. 9 is further tilted from the position shown in FIG. 24A. As described above, the line drawing array direction changes between the background image portion 12 and the message image portion 13 of the second image 11. However, the line drawings are fine line drawings that are hard to visually recognize. In addition, the transmission light amount, diffused reflection light amount, and specular reflection light amount on the ink coating of the background image portion 12 with a vertical array almost equal those on the ink coating of the message image portion 13 with a horizontal array. For these reasons, the background image portion 12 and message image portion 13, which have different line drawing array directions, are hard to visually discriminate.

In addition, as compared to the case shown in FIG. 23 in which the printed matter is observed straight from the upper side, the specular reflection light amount is larger than the transmission light amount in the background image portion 12 and message image portion 13. Hence, the color component of the first image 10 is hardly visually recognized. For this reason, the first image 10 is visually recognized as if it were invisible. That is, the first image 10 is visually recognized as a solid image 17 which appears to have no image printed in it. In this case, under a weak light source, the specular reflection light amount of the second image 11 is small, and the first image 10 can visually be recognized.

Figure 24C:
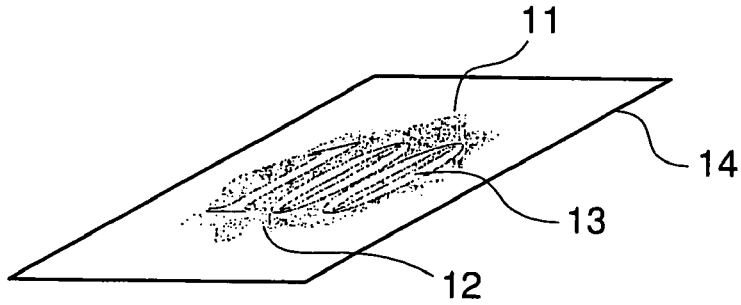

FIG. 24C shows a state wherein the printed matter shown in FIG. 22 is further tilted from the position shown in FIG. 24B. The line drawing array direction changes between the background image portion 12 and the message image portion 13 of the second image 11 shown in FIG. 20C. For this reason, in the message image portion 13 with a horizontal array, the light of the specular reflection light amount is confirmed bright because the specular reflection light amount is larger than the transmission light amount and diffused reflection light amount on the ink coating.

On the other hand, in the background image portion 12 with a vertical array, the transmission light amount and diffused reflection light amount on the ink coating are larger than and the specular reflection light amount is smaller than in the message image portion 13. Hence, the light is confirmed dark. The message image portion 13 is therefore confirmed as a negative image. In the background image portion 12 and message image portion 13 of the second image 11, the specular reflection light amount is larger than that obtained when the printed matter is observed straight from the upper side, as shown in FIG. 23. Hence, the color component of the first image 10 is hard to visually recognize. The first image 10 is visually recognized as if it were invisible.

Figure 24D:
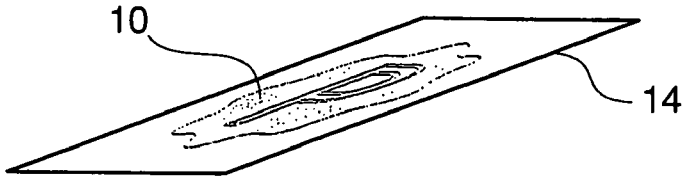

FIG. 24D shows a state wherein the printed matter shown in FIG. 22 is further tilted from the position shown in FIG. 24C. The line drawing array direction changes between the background image portion 12 and the message image portion 13 of the second image 11 shown in FIG. 20C. However, the line drawings are fine line drawings that are hard to visually recognize. In addition, the transmission light amount, diffused reflection light amount, and specular reflection light amount on the ink coating of the background image portion 12 with a vertical array almost equal those on the ink coating of the message image portion 13 with a horizontal array. For these reasons, the background image portion 12 and message image portion 13, which have different line drawing array directions, are hard to visually discriminate.

In addition, as compared to the case shown in FIG. 23 in which the printed matter is observed straight from the upper side, the transmission light amount of the background image portion 12 and message image portion 13 is large. The transmission light becomes light reflected by the first image 10. The first image 10 is visually confirmed. Hence, it is visually recognized as the same state as that obtained when the printed matter is observed straight from the upper side, as shown in FIG. 23.

FIGS. 25A, 25B, 25C, and 25D show states wherein the printed matter shown in FIG. 22 is tilted continuously and observed from the Y direction.

Figure 25A:
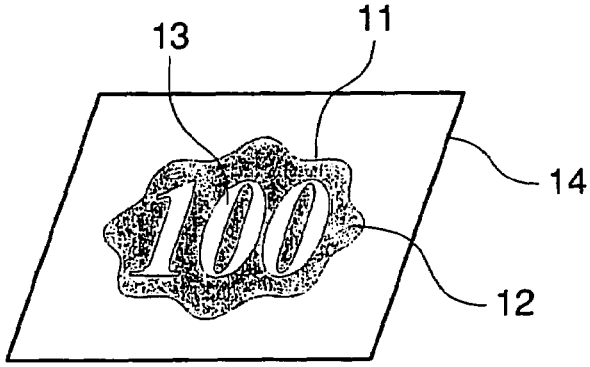
FIGS. 25A, 25B, 25C, and 25D are explanatory views showing the visibilities of the first and second images when the printed matter is observed at various angles in the Y direction.

FIG. 25A shows a state wherein the printed matter shown in FIGS. 21 and 22 is tilted at a shallow angle.

The line drawing array direction changes between the background image portion 12 and the message image portion 13 in the second image 11 shown in FIG. 20C. For this reason, in the message image portion 13 with a vertical array, incident light is confirmed bright because the specular reflection light amount is larger than the transmission light amount and diffused reflection light amount on the ink coating.

On the other hand, in the background image portion 12 with a horizontal array, the transmission light amount and diffused reflection light amount on the ink coating are larger than in the message image portion 13, and the specular reflection light amount is smaller. Hence, the light is confirmed dark.

As a result, the message image portion 13 is confirmed as a negative image. In the background image portion 12 and message image portion 13 in the second image 11, the specular reflection light amount is larger than that obtained when the printed matter is observed straight from the upper side, as shown in FIG. 23. Hence, the color component of the first image 10 is hard to visually recognize. The first image 10 is visually recognized as if it were invisible.

Figure 25B:
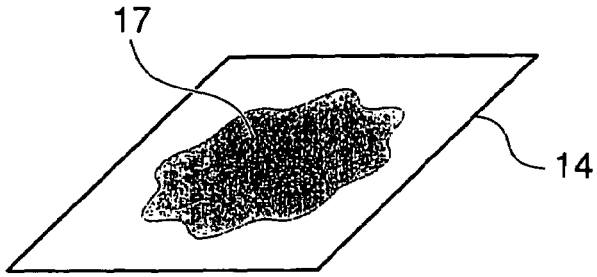

FIG. 25B shows a state wherein the printed matter shown in FIG. 22 is further tilted from the state shown in FIG. 25A.

The line drawing array direction changes between the background image portion 12 and the message image portion 13 of the second image 11 shown in FIG. 20C. However, the line drawings are fine line drawings that are hard to visually recognize. In addition, the transmission light amount, diffused reflection light amount, and specular reflection light amount on the ink coating of the background image portion 12 with a horizontal array almost equal those on the ink coating of the message image portion 13 with a vertical array. For these reasons, the background image portion 12 and message image portion 13, which have different line drawing array directions, are hard to visually discriminate.

In addition, as compared to the case shown in FIG. 23 in which the printed matter is observed straight from the upper side, the specular reflection light amount is larger than the transmission light amount in the background image portion 12 and message image portion 13. Hence, the color component of the first image 10 is hardly visually recognized. For this reason, the first image 10 is visually recognized as if it were invisible.

The first image 10 is visually recognized as the solid image 17 which appears to have no image printed in it. In this case, under a weak light source, the specular reflection light amount of the second image 11 is small, and the first image 10 can visually be recognized.

Figure 25C:
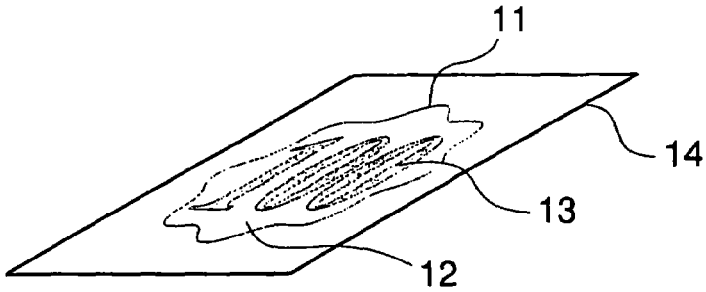

FIG. 25C shows a state wherein the printed matter shown in FIG. 22 is further tilted from the state shown in FIG. 25B. The line drawing array direction changes between the background image portion 12 and the message image portion 13 of the second image 11 shown in FIG. 20C. For this reason, in the background image portion 12 with a horizontal array, the light of the specular reflection light amount is confirmed bright because the specular reflection light amount is larger than the transmission light amount and diffused reflection light amount on the ink coating.

On the other hand, in the message image portion 13 with a vertical array, the transmission light amount and diffused reflection light amount on the ink coating are larger than and the specular reflection light amount is smaller than in the background image portion 12. Hence, the light is confirmed dark. The message image portion 13 is therefore confirmed as a positive image. In the background image portion 12 and message image portion 13 of the second image 11, the specular reflection light amount is larger than that obtained when the printed matter is observed straight from the upper side, as shown in FIG. 23. Hence, the color component of the first image 10 shown in FIG. 20A is hard to visually recognize. The first image 10 is visually recognized as if it were invisible.

Figure 25D:
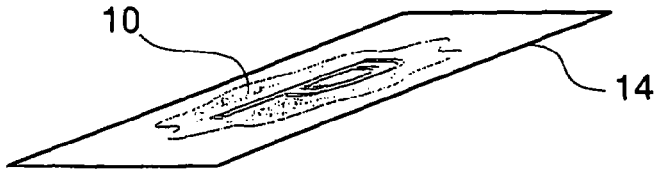

FIG. 25D shows a state wherein the printed matter shown in FIG. 22 is further tilted from the state shown in FIG. 25C. The line drawing array direction changes between the background image portion 12 and the message image portion 13 of the second image 11 shown in FIG. 20C. However, the line drawings are fine line drawings that are hard to visually recognize. In addition, the transmission light amount, diffused reflection light amount, and specular reflection light amount on the ink coating of the message image portion 13 with a vertical array almost equal those on the ink coating of the background image portion 12 with a horizontal array. For these reasons, the background image portion 12 and message image portion 13, which have different line drawing array directions, are hard to visually discriminate.

In addition, as compared to the case shown in FIG. 23 in which the printed matter is observed straight from the upper side, the transmission light amount of the background image portion 12 and message image portion 13 is large. The transmission light becomes light reflected by the first image 10. The first image 10 is visually confirmed. Hence, it is visually recognized as the same state as that obtained when the printed matter is observed straight from the upper side, as shown in FIG. 23.

That is, when the printed matter shown in FIGS. 21 and 22 is continuously tilted and observed straight from the upper side, the message image of the second image 11 can be confirmed because it is switched from a negative image to a positive image or from a positive image to a negative image. In addition, the first image 10 gradually becomes hard to visually recognize and then appears again.

The timing for making the first image 10 visible or invisible changes depending on the light amount of the light source and the lightness of the color of the first image 10.

The timing for making the second image 11 appear as a negative image or positive image changes depending on the light amount of the light source and the pitch of the line drawing.

When the printed matter of this embodiment is continuously tilted and observed straight from the upper side, and the message image portion 13 formed in the second image 11 should clearly be recognized, the line drawing of the background image portion 12 and that of the message image portion 13 are formed by using at least one of a straight line pattern and a dot pattern. With this arrangement, the brightness difference becomes large because of the difference of reflection light amount between the background image portion 12 and the message image portion 13. Hence, the visibility of the latent image portion of the message image portion 13 improves.

The straight line pattern can be formed from a straight straight line pattern, curved straight line pattern, or concentric circular pattern, and its shape is not particularly limited.

The image lines and non-image lines of the straight line pattern or dot pattern are preferably formed at an equal interval.

The angle made by the line drawing of the background image portion 12 and that of the message image portion 13, which have different array directions, preferably falls within the range of about 30° to 150°.

Preferably, when the angle of the array direction of the line drawing of the background image portion 12 is defined as 0°, the angle of the array direction of the line drawing of the message image portion 13 is preferably about 90°.

For example, when the second image 11 has three message image portions 13, and the angle of the background image portion 12 is defined as 0°, the angles of the array directions of the line drawings in the message image portions 13 may be set to 45°, 90°, and 135°.

In the line drawing of the background image portion 12 and that of the message image portion of this embodiment, the width of each image line is changed stepwise and/or continuously such that a latent image having an arbitrary tone level appears when the printed matter is tilted. This further increases the anti-forgery effect.

When the printed matter of this embodiment is continuously tilted and observed straight from the upper side, and the message image portion 13 formed in the second image 11 should clearly be recognized, the line drawing of this embodiment must have an ink layer thickness. The ink layer thickness of each line drawing of the background image portion 12 and message image portion 13 preferably falls within the range of 10 to 150 μm. If the ink layer thickness is smaller than 10 μm, the message image portion 13 hardly clearly appears even when the printed matter is continuously tilted and observed straight from the upper side. When the ink layer thickness exceeds 150 μm, the printed matter can hardly be manufactured.

The printing means used for printing of this embodiment is not particularly limited. However, the first image 10 is preferably printed by an offset printing method. The second image 11 is preferably printed by using an intaglio printing method or screen printing method. No special adjustment is necessary in adjusting the printing press. Printing can be executed on the basis of general settings.

As the base member, paper sheets, plastic films, metals, and cloth can be used.

The second embodiment will be described below in more detail by way of its examples. However, the present invention is not limited to these examples.

EXAMPLE 3

A PS plate with an image pattern of a character "P" was prepared. The first image 10 shown in FIG. 26 was printed by an offset printing method using a green ink to obtain printed matter of the first image 10. With a colorimeter, L* in the L*a*b* colorimetric system was measured to be 93.35.

Figure 26:
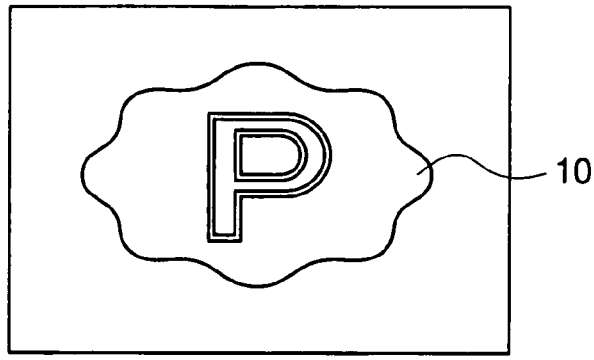
FIG. 26 is a plan view showing the printed matter on which the first image is printed.

The image line of the second image 11 shown in FIG. 26 was image patterned by using a computer. When the angle of the array direction of the line drawing of the background image portion 12 was defined as 0°, the line drawing of the message image portion 13 was 90°. For the line drawing of the background image portion 12 and message image portion 13, the pitch was 200 μm, and the image line width was 100 μm.

On the basis of the image patterned image line of the second image 11, a screen printing plate was prepared. An ink was prepared at the following mixing ratio.

Composition of Screen Printing Ink

| | |
|---|---|
| Pigment ($SiO_2$: silica powder) | 10 parts by weight |
| Urethane acrylate (UX-4101 available from Nippon Kayaku) | 50 parts by weight |
| Monomer (PEG-400DA available from Nippon Kayaku) | 30 parts by weight |
| Initiator (Irgacure819 available from Ciba Specialty Chemicals) | 9 parts by weight |
| Inhibitor (Methylhydroquinone available from Tokyo Kasei Kogyo) | 0.5 parts by weight |
| Antifoaming agent (SC5540 available from Toray Dow Corning Silicone) | 0.5 parts by weight |

Figure 27:
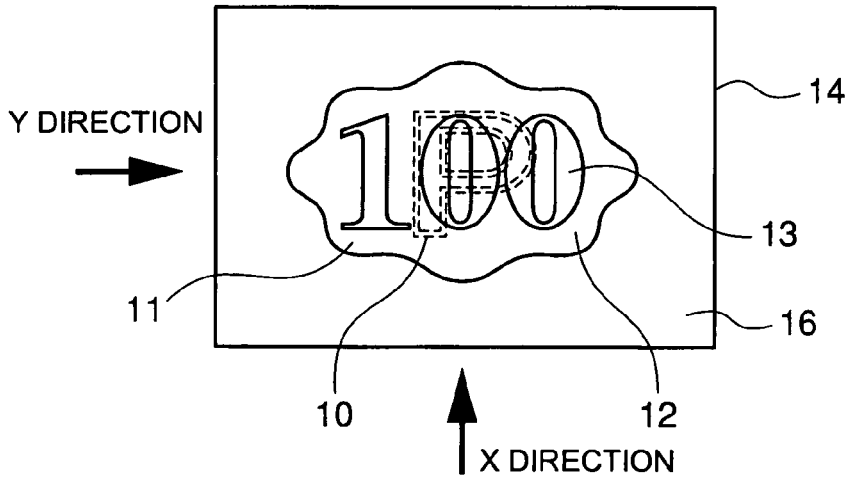
FIG. 27 is a plan view showing another example of the structure of the printed matter according to the second embodiment.

The second image 11 was printed on the printed matter of the first image 10 by a screen printing press using the resultant screen printing plate and screen ink. The ink was cured by a UV ray irradiation apparatus, thereby obtaining printed matter 16 of Example 3 shown in FIG. 27.

Figure 28:
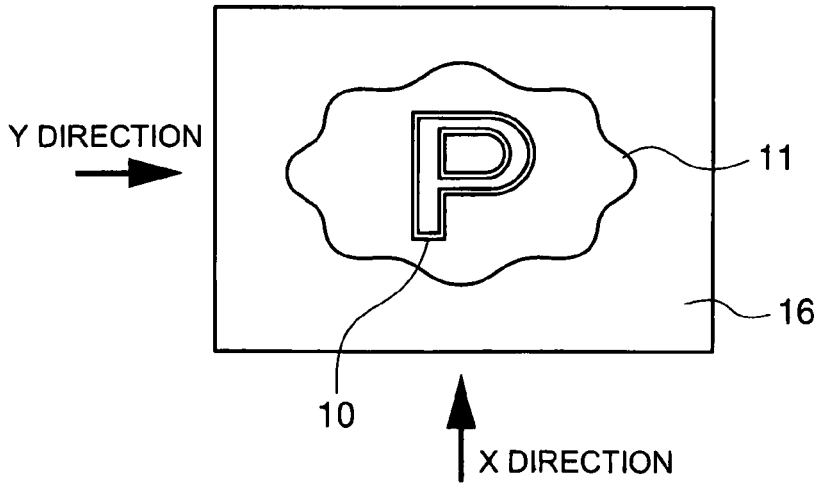
FIG. 28 is a plan view showing the visibilities of the first and second images when the printed matter is observed straight from the upper side.

FIG. 28 shows a state wherein the printed matter 16 of Example 3 was observed straight from the upper side. As shown in FIG. 28, when the printed matter 16 is observed straight from the upper side, the background image portion 12 and message image portion 13 of the second image 11 cannot visually be identified. Since the second image 11 on the first image 10 was printed by a semitransparent ink, only the first image 10 could be confirmed through the second image 11.

FIGS. 29A, 29B, 29C, and 29D show states wherein the resultant printed matter was tilted continuously and observed from the X direction.

Figure 29A:
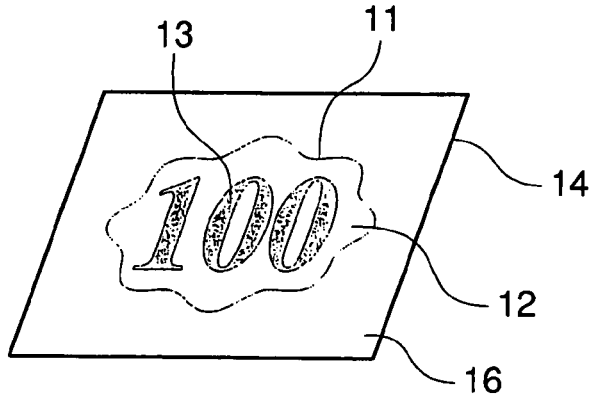
FIGS. 29A, 29B, 29C, and 29D are explanatory views showing the visibilities of the first and second images when the printed matter is observed at various angles.

FIG. 29A shows the printed matter tilted by 30°. When the printed matter was tilted by 30°, the character "P" of the first image 10 disappeared, and the character "100" of the message image portion 13 of the second image 11 was confirmed as a positive image.

Figure 29B:
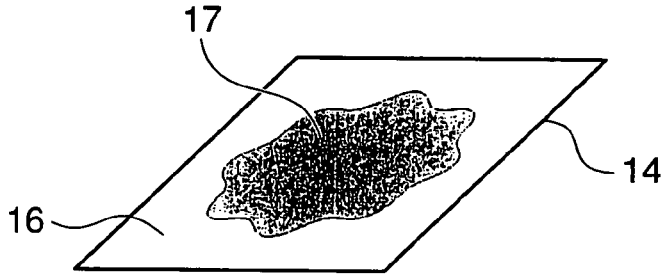

FIG. 29B shows the printed matter tilted by 45°. When the printed matter was tilted by 45°, the image was confirmed as the solid image 17 which appeared to have no image printed in it.

Figure 29C:
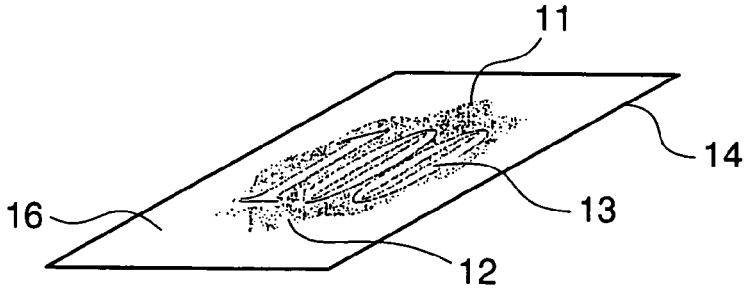

FIG. 29C shows the printed matter tilted by 60°. When the printed matter was tilted by 60°, the character "P" of the first image 10 disappeared again, and the character "100" of the message image portion 13 of the second image 11 was confirmed as a negative image.

Figure 29D:
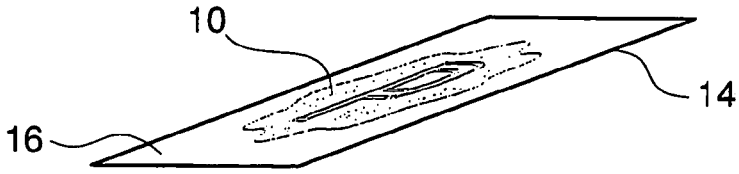

FIG. 29D shows the printed matter tilted by 75°. When the printed matter was tilted by 750, the character "P" of the first image 10 appeared again, and the character "100" of the message image portion 13 of the second image 11 disappeared. That is, the same state as in FIG. 28, in which the printed matter was observed straight from the upper side, was obtained. When the printed matter was tilted by 30° in the Y direction, the character "P" of the message image portion 13 was confirmed as a negative image. When the printed matter was tilted by 60°, the character "P" was confirmed as a positive image. The manner the image is seen at an observation angle changes depending on the light source. Hence, the present invention is not limited to the observation angles of the above example.

EXAMPLE 4

The second image 11 was printed in accordance with the same procedures as in Example 3 by using an ink prepared at the following mixing ratio to obtain printed matter according to Example 4.

Composition of Screen Printing Ink

| | |
|---|---|
| Scaly pigment (Pearl pigment with high orientation available from Merck Japan) | 20 parts by weight |
| Urethane acrylate (UX-4101 available from Nippon Kayaku) | 40 parts by weight |
| Monomer (PEG-400DA available from Nippon Kayaku) | 30 parts by weight |
| Initiator (Irgacure819 available from Ciba Specialty Chemicals) | 9 parts by weight |
| Inhibitor (Methylhydroquinone available from Tokyo Kasei Kogyo) | 0.5 parts by weight |
| Antifoaming agent (SC5540 available from Toray Dow Corning Silicone) | 0.5 parts by weight |

When the printed matter according to Example 4 was tilted continuously and observed from the X or Y direction, the message image portion 13 was more clearly confirmed than the printed matter of Example 3.

REFERENCE EXAMPLE 3

Printed matter (of solvent dry type) according to Reference Example 3 was obtained in accordance with the same procedures as in Example 3 by using an ink prepared at the following mixing ratio.

Composition of Screen Printing Ink

| | |
|---|---|
| Scaly pigment Pigment as in Example 4 (pearl pigment with high orientation available from Merck Japan) | 20 parts by weight |
| Solvent type varnish (SG720 available from Seiko Advance) | 79.5 parts by weight |
| Antifoaming agent (SC5540 available from Toray Dow Corning Silicone) | 0.5 parts by weight |

When the printed matter of Reference Example 3 was observed obliquely, the message image portion 13 could not visually be recognized.

To determine the appropriate lightness of the first image 10 and the appropriate ink layer thickness of the second image 11, samples of the second image 11 were prepared using ink as in Example 4 by changing the ink layer thickness, and samples of the first image 10 were prepared by changing the lightness. Resultant printed matter was tilted and observed to test the visibility of the message image portion 13 and the disappearing effect of the first image 10.

The evaluation was done on a 1-to-3 scale. A message image whose change from a negative image to a positive image could clearly be recognized was rated ○. A message image whose change could be recognized but not clearly was rated Δ. A message image that could hardly be confirmed or could not be confirmed at all was rated ×. FIGS. 30 to 34 show the evaluation results. In addition, the first image 10 that disappeared was rated ○. The first image 10 that disappeared but not clearly was rated Δ. The first image 10 that did not disappear was rated ×. FIGS. 35 to 39 show the evaluation results.

As is apparent from the evaluation results, the ink layer thickness of the second image 11 is preferably 10 μm or more.

In addition, the printed matter of the first image 10 preferably has a lightness of 90 or more. Hence, preferably, the first image 10 has a lightness of 90 or more, and the second image 11 has an ink layer thickness of 10 μm or more.

To obtain a preferably line drawing pitch with which the background image portion 12 and message image portion 13 of the second image 11 could not be discriminated when the printed matter of this example was observed straight from the upper side, samples were prepared by changing the image line pitch. The resultant printed matter was observed straight from the upper side to test the visibility.

The evaluation was done on a 1-to-3 scale. Printed matter in which the background image portion 12 and message image portion 13 were not be discriminated was rated ○. Printed matter in which the background image portion 12 and message image portion 13 might be discriminated was rated Δ. Printed matter in which the background image portion 12 and message image portion 13 were discriminated was rated ×. In addition, the printed matter was tilted and observed to test the visibility of the message image portion 13. The evaluation was done on a 1-to-3 scale. A message image whose change from a negative image to a positive image could clearly be recognized was rated ○. A message image whose change could be recognized but not clearly was rated Δ. A message image that could hardly be confirmed or could not be confirmed at all was rated ×. FIG. 40 shows the evaluation results.

As is apparent from FIG. 40, the image line width of each of the line drawing of the background image portion 12 and that of the message image portion 13 preferably falls within 30 to 1,000 μm.

The present invention is not limited to the above embodiments and examples, and various changes and modifications can be made within the spirit and scope of the technical concepts of the following claims.

According to the second embodiment and Examples 3 and 4, when the printed matter of the present invention is observed straight from the upper side, the background image portion and message image portion of the second image formed by a line drawing cannot visually be confirmed. Hence, only the first image can be confirmed. When the printed matter is tilted continuously and observed straight from the upper side, the message image of the second image can be confirmed because it is switched from a negative image to a positive image or from a positive image to a negative image. On the other hand, the first image gradually becomes hard to visually recognize and then appears again.

For this reason, everybody can easily determine the authenticity on the spot without using any expensive authenticity determination apparatus.

When the line drawing pitch, image line ink layer thickness, and pigment of the second image are specified, and the printed matter is tilted continuously and observed straight from the upper side, the latent image of the second image can more clearly be confirmed because it is continuously switched from a negative image to a positive image or from a positive image to a negative image. The visual effect is excellent, and the authenticity can easily be determined.

Furthermore, the ink layer thickness need not be more than necessary. Since a process such as embossing is not executed, the influence on the lower side of the printing surface can be eliminated. The problem that the effect is lost by a pressure can be solved. Since the two steps of printing and embossing are unnecessary, the operation efficiency can be increased.

When printed matter in which the second image is formed by using an ink containing an optical change pigment such as a pearl pigment is tilted continuously and observed straight from the upper side, the degree of the change of the message image portion from a negative image to a positive image or from a positive image to a negative image becomes conspicuous without damaging the optical effect. Hence, a higher anti-forgery effect can be obtained. In addition, a large anti-copy effect unique to the optical change pigment can be obtained. Since the image line itself has an ink layer thickness, tactile sensible printed matter can be obtained.

What is claimed is:

1. An authenticity determinable printed matter comprising a background image portion and at least one message image portion printed on a surface of a base member, wherein the background image portion has a first line drawing which is arrayed in a first direction and printed by an ink with a specular gloss to have an ink layer thickness, and the message image portion has a second line drawing which is arrayed in a second direction and printed by the ink with the specular gloss to have the ink layer thickness, and wherein when the printed matter is observed from a direction in which a total light amount as a sum of a specular reflection light amount and a diffusion light amount in the first line drawing substantially equals that in the second line drawing, the message image is rarely visually recognized, when the printed matter is observed from a direction in which the total light amount in the first line drawing is different from that in the second line drawing, the message image is visually recognized, when an observation angle is changed, a lightness and/or color of the message image continuously changes, when the total light amount in the first line drawing is larger than that in the second line drawing, the background image portion has a higher lightness than the message image portion, and the message image portion is visually recognized as a positive image, and when the total light amount in the second line drawing is larger than that in the first line drawing, the message image portion has a higher lightness than the background image portion, and the message image portion is visually recognized as a negative image.

2. The printed matter according to claim 1, wherein each of the background image portion and the message image portion is screen-printed by the ink with the specular gloss.

3. The printed matter according to claim 1, wherein each of the first line drawing and the second line drawing contains a straight line pattern and/or a curved straight line pattern.

4. The printed matter according to claim 1, wherein an image line width in each of the first line drawing and the second line drawing falls within a range of 30 to 1,000 μm.

5. The printed matter according to claim 1, wherein an ink layer thickness in each of the first line drawing and the second line drawing falls within a range of 10 to 150 μm.

6. The printed matter according to claim 1, wherein the ink used to print the first line drawing and the second line drawing is one of a UV curing ink and an electron radiation curing ink.

7. The printed matter according to claim 1, wherein the ink used to print the first line drawing and the second line drawing contains at least one of a scaly pigment, a metal powder pigment, glass flakes, and a cholesteric liquid crystal pigment.

8. The printed matter according to claim 7, wherein a surface treatment for causing the ink to have water- and oil-repellent properties is executed for the ink to improve planar orientation of one of the scaly pigment, the metal powder pigment, the glass flakes, and the cholesteric liquid crystal pigment.

9. A method of manufacturing authenticity determinable printed matter which has a background image portion and at least one message image portion on a surface of a base member, comprising the steps of:

printing a first line drawing contained in the background image portion by using an ink with a specular gloss to make the first line drawing arrayed in a first direction and have an ink layer thickness; and printing a second line drawing contained in the message image portion by using the ink with the specular gloss to make the second line drawing arrayed in a second direction and have the ink layer thickness, wherein the first line drawing and the second line drawing are printed such that when the printed matter is observed from a direction in which a total light amount as a sum of a specular reflection light amount and a diffusion light amount in the first line drawing substantially equals that in the second line drawing, the message image is rarely visually recognized, when the printed matter is observed from a direction in which the total light amount in the first line drawing is different from that in the second line drawing, the message image is visually recognized, when an observation angle is changed, a lightness and/or color of the message image continuously changes, when the total light amount in the first line drawing is larger than that in the second line drawing, the background image portion has a higher lightness than the message image portion, and the message image portion is visually recognized as a positive image, and when the total light amount in the second line drawing is larger than that in the first line drawing, the message image portion has a higher lightness than the background image portion, and the message image portion is visually recognized as a negative image.

10. The method according to claim 9, wherein each of the background image portion and the message image portion is screen-printed by using the ink with the specular gloss.

11. The method according to claim 9, wherein each of the first line drawing and the second line drawing is printed to contain a straight line pattern and/or a curved straight line pattern.

12. The method according to claim 9, wherein each of the first line drawing and the second line drawing is printed to make an image line width fall within a range of 30 to 1,000 μm.

13. The method according to claim 9, wherein each of the first line drawing and the second line drawing is printed to make an ink layer thickness fall within a range of 10 to 150 μm.

14. The method according to claim 9, wherein each of the first line drawing and the second line drawing is printed by using one of a UV curing ink and an electron radiation curing ink.

15. The method according to claim 9, wherein each of the first line drawing and the second line drawing is printed by using the ink that contains at least one of a scaly pigment, a metal powder pigment, glass flakes, and a cholesteric liquid crystal pigment.

16. The method according to claim 15, wherein each of the first line drawing and the second line drawing is printed by using the ink for which a surface treatment for causing the ink to have water- and oil-repellent properties is executed to improve planar orientation of one of the scaly pigment, the metal powder pigment, the glass flakes, and the cholesteric liquid crystal pigment.

17. An authenticity determinable printed matter comprising a first image printed on a surface of a base member, and a second image printed on the first image, wherein the first image at least partially has a region where L* in an L*a*b* colorimetric system is not less than 90 when measured by a colorimeter, and the second image has a line drawing which is printed by one of a semitransparent ink having a specular gloss and a semitransparent ink containing a pigment with planar orientation to have an ink layer thickness.

18. The printed matter according to claim 17, wherein when the printed matter is observed from a direction in which a total light amount as a sum of a specular reflection light amount and a diffusion light amount in the first image substantially equals that in the second image, the first image is more clearly visually recognized than the second image, and when the printed matter is observed while gradually changing an angle of the printed matter from the direction in which the total light amount in the first image substantially equals that in the second image to a direction in which the total light amount in the first image is different from that in the second image, the first image gradually becomes hard to visually recognize and then becomes visible again.

19. The printed matter according to claim 17, wherein the ink used for the second image contains at least one of a scaly pigment, a metal powder pigment, glass flakes, and a cholesteric liquid crystal pigment.

20. The printed matter according to claim 17, wherein the second image contains a background image portion and at least one message image portion, the line drawing contains a first line drawing contained in the background image portion and a second line drawing contained in the message image portion and having an array direction different from that of the first line drawing, when the printed matter is observed from the direction in which the total light amount as the sum of the specular reflection light amount and the diffusion light amount in the first image substantially equals that in the second image, the background image portion and the message image portion, which are contained in the second image, can rarely visually be identified, and when the printed matter is observed while gradually changing the angle of the printed matter from the direction in which the total light amount in the first image substantially equals that in the second image to the direction in which the total light amount in the first image is different from that in the second image, the message image in the second image changes from a negative image to a positive image or from a positive image to a negative image and is visually recognized, and the first image gradually becomes hard to visually recognize and then becomes visible again.

21. The printed matter according to claim 20, wherein each of the first line drawing and the second line drawing contains a straight line pattern and/or a dot pattern.

22. The printed matter according to claim 20, wherein an image line width in each of the first line drawing and the second line drawing falls within a range of 30 to 1,000 μm.

23. The printed matter according to claim 20, wherein an ink layer thickness in each of the first line drawing and the second line drawing falls within a range of 10 to 150 μm.

24. The printed matter according to claim 20, wherein the ink used to print the first line drawing and the second line drawing is one of a UV curing ink, an electron radiation curing ink, and a solvent ink.

25. The printed matter according to claim 17, wherein a surface treatment for causing the ink to have water- and oil-repellent properties is executed for the ink to improve planar orientation of the pigment.

26. A method of manufacturing authenticity determinable printed matter in which a first image is printed on a surface of a base member, and a second image is printed on the first image, comprising the steps of:

printing the first image which at least partially has a region where L* in an L*a*b* colorimetric system is not less than 90 when measured by a colorimeter, and printing a line drawing contained in the second image by one of a semitransparent ink having a specular gloss and a semitransparent ink containing a pigment with planar orientation to make the line drawing have an ink layer thickness.

27. The method according to claim 26, wherein the first image and the second image are printed such that when the printed matter is observed from a direction in which a total light amount as a sum of a specular reflection light amount and a diffusion light amount in the first image substantially equals that in the second image, the first image is more clearly visually recognized than the second image, and when the printed matter is observed while gradually changing an angle of the printed matter from the direction in which the total light amount in the first image substantially equals that in the second image to a direction in which the total light amount in the first image is different from that in the second image, the first image gradually becomes hard to visually recognize and then becomes visible again.

28. The method according to claim 26, wherein the second image is printed by using an ink containing at least one of a scaly pigment, a metal powder pigment, glass flakes, and a cholesteric liquid crystal pigment.

29. The method according to claim 26, wherein the first image and the second image are printed such that the second image contains a background image portion and at least one message image portion, the line drawing contains a first line drawing contained in the background image portion and a second line drawing contained in the message image portion and having an array direction different from that of the first line drawing, when the printed matter is observed from the direction in which the total light amount as the sum of the specular reflection light amount and the diffusion light amount in the first image substantially equals that in the second image, the background image portion and the message image portion, which are contained in the second image, can rarely visually be identified, and when the printed matter is observed while gradually changing the angle of the printed matter from the direction in which the total light amount in the first image substantially equals that in the second image to the direction in which the total light amount in the first image is different from that in the second image, the message image in the second image changes from a negative image to a positive image or from a positive image to a negative image and is visually recognized, and the first image gradually becomes hard to visually recognize and then becomes visible again.

30. The method according to claim 29, wherein each of the first line drawing and the second line drawing is printed to contain a straight line pattern and/or a dot pattern.

31. The method according to claim 29, wherein each of the first line drawing and the second line drawing is printed to make an image line width fall within a range of 30 to 1,000 μm.

32. The method according to claim 29, wherein each of the first line drawing and the second line drawing is printed to make an ink layer thickness fall within a range of 10 to 150 μm.

33. The method according to claim 29, wherein each of the first line drawing and the second line drawing is printed by using one of a UV curing ink, an electron radiation curing ink, and a solvent ink.

34. The method according to claim 26, wherein a surface treatment for causing the ink to have water- and oil-repellent properties is executed for the ink to improve planar orientation of the pigment.

* * * * *

UNITED STATES PATENT AND TRADEMARK OFFICE

CERTIFICATE OF CORRECTION

PATENT NO. : 7,354,072 B2
APPLICATION NO. : 10/486013
DATED : April 8, 2008
INVENTOR(S) : Yokote et al.

It is certified that error appears in the above-identified patent and that said Letters Patent is hereby corrected as shown below:

Title page, page 2, see Item (56) References Cited, FOREIGN PATENT DOCUMENTS, insert the following three Japanese references:

JP 2615401
JP 57006765
JP 2113880

Signed and Sealed this

Sixteenth Day of September, 2008

JON W. DUDAS
*Director of the United States Patent and Trademark Office*